US007048631B2

(12) United States Patent
Goins et al.

(10) Patent No.: US 7,048,631 B2
(45) Date of Patent: May 23, 2006

(54) GAMING DEVICE HAVING A GAME WITH A FUNCTIONAL REFRACTIVE LIGHT DISPLAY

(75) Inventors: Jamie J. Goins, Reno, NV (US); Gene E. Powell, Reno, NV (US); Brian T. Riffel, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 625 days.

(21) Appl. No.: 09/967,267

(22) Filed: Sep. 28, 2001

(65) Prior Publication Data

US 2003/0064799 A1 Apr. 3, 2003

(51) Int. Cl.
*A63F 9/24* (2006.01)

(52) U.S. Cl. ..... 463/31; 463/34; 40/546

(58) Field of Classification Search ..... 463/30–31, 463/16–22, 32–34; 359/629–631, 634, 639; 273/138.1, 138.2, 139, 143 R; 40/1, 446, 40/448, 453, 541, 546, 547
See application file for complete search history.

(56) References Cited

U.S. PATENT DOCUMENTS

| | | | | | |
|---|---|---|---|---|---|
| 2,617,221 | A | * | 11/1952 | Fuchs | 40/546 |
| 3,800,451 | A | * | 4/1974 | Bulkley | 40/433 |
| 4,422,719 | A | | 12/1983 | Orcutt | |
| 4,679,044 | A | | 7/1987 | Knoll | |
| 4,689,604 | A | * | 8/1987 | Sokol | 345/31 |
| 4,949,489 | A | | 8/1990 | Rudell et al. | |
| 5,121,229 | A | | 6/1992 | Benton et al. | |
| 5,178,447 | A | | 1/1993 | Murase et al. | |
| 5,207,493 | A | | 5/1993 | Murase et al. | |
| 5,408,387 | A | | 4/1995 | Murase et al. | |
| 5,410,454 | A | | 4/1995 | Murase et al. | |
| 5,499,165 | A | | 3/1996 | Holmes, Jr. | |
| 5,580,055 | A | | 12/1996 | Hagiwara | |
| 5,664,862 | A | | 9/1997 | Redmond et al. | |
| 5,752,881 | A | | 5/1998 | Inoue | |
| 5,848,932 | A | * | 12/1998 | Adams | 463/20 |
| 5,870,068 | A | * | 2/1999 | Hildebrand et al. | 345/8 |
| 5,915,855 | A | | 6/1999 | Murase et al. | |
| 6,094,849 | A | | 8/2000 | Phillips et al. | |
| 6,471,387 | B1 | | 10/2002 | Henshaw et al. | |

FOREIGN PATENT DOCUMENTS

| | | | |
|---|---|---|---|
| GB | 2 028 561 A | | 3/1980 |
| GB | 2 262 642 A | | 12/1992 |
| GB | 2 274 010 A | | 7/1994 |
| JP | 11-033163 | * | 9/1999 |

OTHER PUBLICATIONS

English Translation of JP 11–033163, as provided by the Japan Patent Office website [http://www.ipdl.jpo.go.jp/homepg_e.jpdl].*
Slot Towers for the New Millennium Brochure written by Tripp Plastics, published date unknown.
Tripp Plastics Brochure written by Tripp Plastics, published date unknown.

* cited by examiner

*Primary Examiner*—Mark Sager
(74) *Attorney, Agent, or Firm*—Bell, Boyd & Lloyd LLC

(57) ABSTRACT

The present invention relates to a gaming device having a refractive light display. The gaming device includes a housing, a refractive light display including at least one refractive surface, and a processor for controlling the refractive light display to indicate a game function. Light is directed into the refractive light display and directed from the refractive surfaces to a player. In one embodiment, the refractive light display and an award display are adjacent to each other on a gaming device and co-act to indicate a symbol on the award display in a game. In another embodiment, the refractive light display includes at least one refractive surface that functions as a payline where the payline refracts light and indicates one or more symbols on the reels. In a further embodiment, a reflective layer is formed on one or more of the refractive surfaces to illuminate specific sections in a game.

83 Claims, 16 Drawing Sheets

GAMING DEVICE HAVING A GAME WITH A FUNCTIONAL REFRACTIVE LIGHT DISPLAY

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device, and more particularly to a gaming device having a game with a functional refractive light display.

Gaming device manufacturers strive to make gaming devices that provide as much enjoyment, entertainment and excitement as possible. Providing interesting and exciting primary games and secondary games in which a player has an opportunity to win potentially large awards or credits is one way to enhance player enjoyment and excitement. Another way to enhance a player's enjoyment, entertainment and excitement with a gaming device is by including lights, sounds or other visual or audio or audio-visual effects in the gaming machines.

Known gaming devices use certain lighting effects to enhance the overall look of the machines to players and which are used in primary games or secondary games. Known gaming machines use lighting effects such as light-emitting diodes commonly referred to as LED's. LED's in various sizes and colors have been used to illuminate displays, signs and inputs in gaming devices.

Certain known gaming machines also use LED's to illuminate pieces of glass to create visual effects in signs associated with gaming devices. This lighting effect, commonly known as edge-lit glass, is used to enhance the visual appearance of signs or toppers on or associated with gaming devices. For instance, edge-lit glass is currently used to illuminate signs that describe the theme or name of a gaming device. Edge-lit glass is therefore used to attract players to gaming devices by enhancing the visual appearance of the gaming device.

Edge-lit glass has not been used or employed in the functional aspects of a gaming device, and specifically has not been used functionally in primary or secondary games in gaming devices to make the games more interesting, exciting, entertaining or enjoyable. Additionally, the edge-lit glass and light sources for the displays or signs have not been controlled by a processor to work in conjunction with a game. The light source for edge-lit glass previously employed in displays, signs or inputs was directly powered by a power source without the control of a processor.

SUMMARY OF THE INVENTION

The present invention includes a gaming device having a game with a functional refractive light display. The functional refractive light display may be employed in a primary or secondary game. In one embodiment, the refractive light display is employed in conjunction with one or more symbols or symbol displays. The refractive light display and the symbol display co-act to provide a portion of the game to the player.

In one embodiment, as further discussed below, the refractive light display is positioned adjacent to or in front of a wheel having one or more symbols, one or more reels, or one or more other symbol displays having one or more symbols. The wheel, reel(s) or other symbol display and the refractive light display co-act to indicate or highlight one or more of the symbols on the wheel, reel(s) or other light display to the player in a primary game or secondary game.

In one embodiment, the gaming device includes a housing, a refractive light display mounted in the housing, a light source including a plurality of lights connected to the housing and positioned adjacent to the refractive light display, a symbol display connected to the housing and mounted adjacent to or relative to the refractive light display, a sub-processor that controls the light source to illuminate the refractive light display and a processor which controls the symbol display in communication with the sub-processor. The refractive light display includes a substantially transparent or translucent material such as acrylic, plexi-glass or glass, which has at least one refractive surface. The light source is preferably mounted adjacent to the refractive light display and controls the plurality of lights which direct light into one or more edges of the material. The light travels through the material and is directed outwardly from the refractive surface or surfaces. The light refracted from the surface(s) interacts with the symbols on the symbol display to indicate one or more symbols to the player. In one embodiment, the refractive light display includes a plurality of refractive surfaces that form one or more patterns, images or designs in the refractive light display to indicate one or more symbols on the symbol display or indicate a game state or game mode such as an attract mode, an idle mode, a normal mode, a game play mode, a bonus mode, a cashout mode, a credit roll-up mode, a jackpot mode or other hand pay modes or player tracking modes.

In one embodiment, the refractive light display is mounted adjacent to an award display or indicator such as an award wheel and indicates award symbols on the award indicator. The refractive light display may indicate an award symbol by highlighting a particular section of the award indicator. For example, a colored light may be used to highlight a section of the award wheel.

In one embodiment, the refractive light display is fixed or stationary and the symbol display is also stationary. In an alternative embodiment, the symbol display moves or rotates while the refractive light display remains stationary. In another embodiment, the refractive light display and the symbol display both move or rotate. It should be appreciated that in this embodiment, the refractive light display and the symbol display may move in the same direction or in different or opposite directions. In another embodiment, the symbol display is stationary or fixed and the refractive light display moves or rotates.

In a further embodiment of the present invention, the refractive light display is positioned adjacent to at least one or a plurality of reels. The refractive light display provides one or more refractive surfaces which function as one or more paylines associated with the reels. The refractive surfaces on the refractive light display indicate the winning positions for the symbols on the reels. In this embodiment, as well as in the other embodiments, one or more light sources may be used to illuminate the refractive surfaces. The light sources may be of the same or different color lights. The paylines may thus be the same color, different colors or any combination thereof. Also, the paylines may sequentially have different colors.

In a further embodiment of the present invention, the functional refractive light display is used to provide the symbols to the player. In particular, the functional refractive surfaces are used to form one or more patterns, images or symbols in a primary game or a secondary game. For instance, the functional refractive light display may include a plurality of refractive surfaces which provide the bonus symbols in a bonus game.

It is therefore an advantage of the present invention to provide gaming device with a functional refractive light display.

A further advantage of the present invention is to provide a gaming device having a functional refractive light display that indicates symbols on a symbol display.

Another advantage of the present invention is to provide a gaming device having a functional refractive light display that provides symbols in a game of a gaming device.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
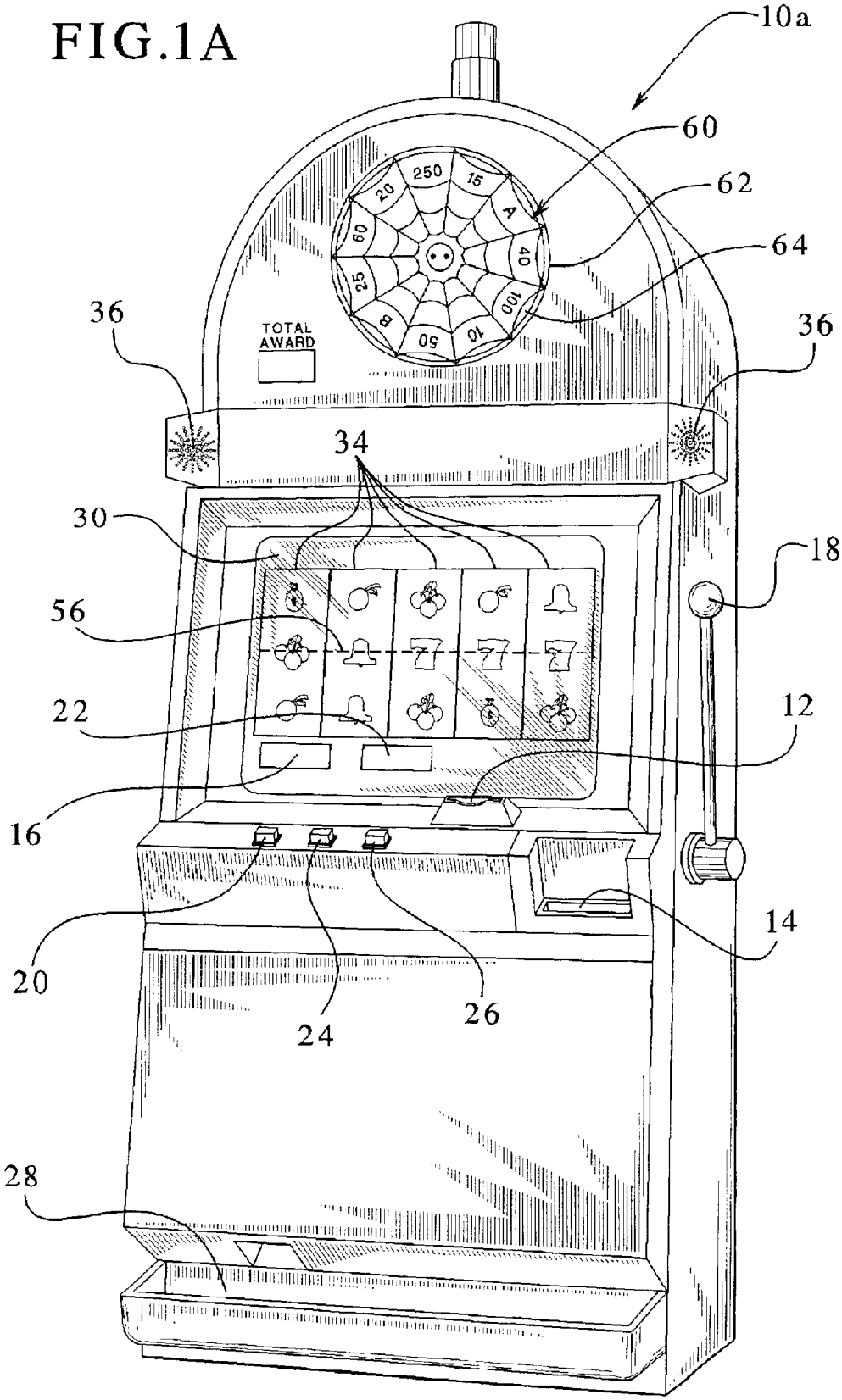
FIG. 1A is a front perspective view of one embodiment of the gaming device of the present invention which includes refractive light display mounted in front of a symbol display in the form of a mechanical award wheel.
Figure 1B:
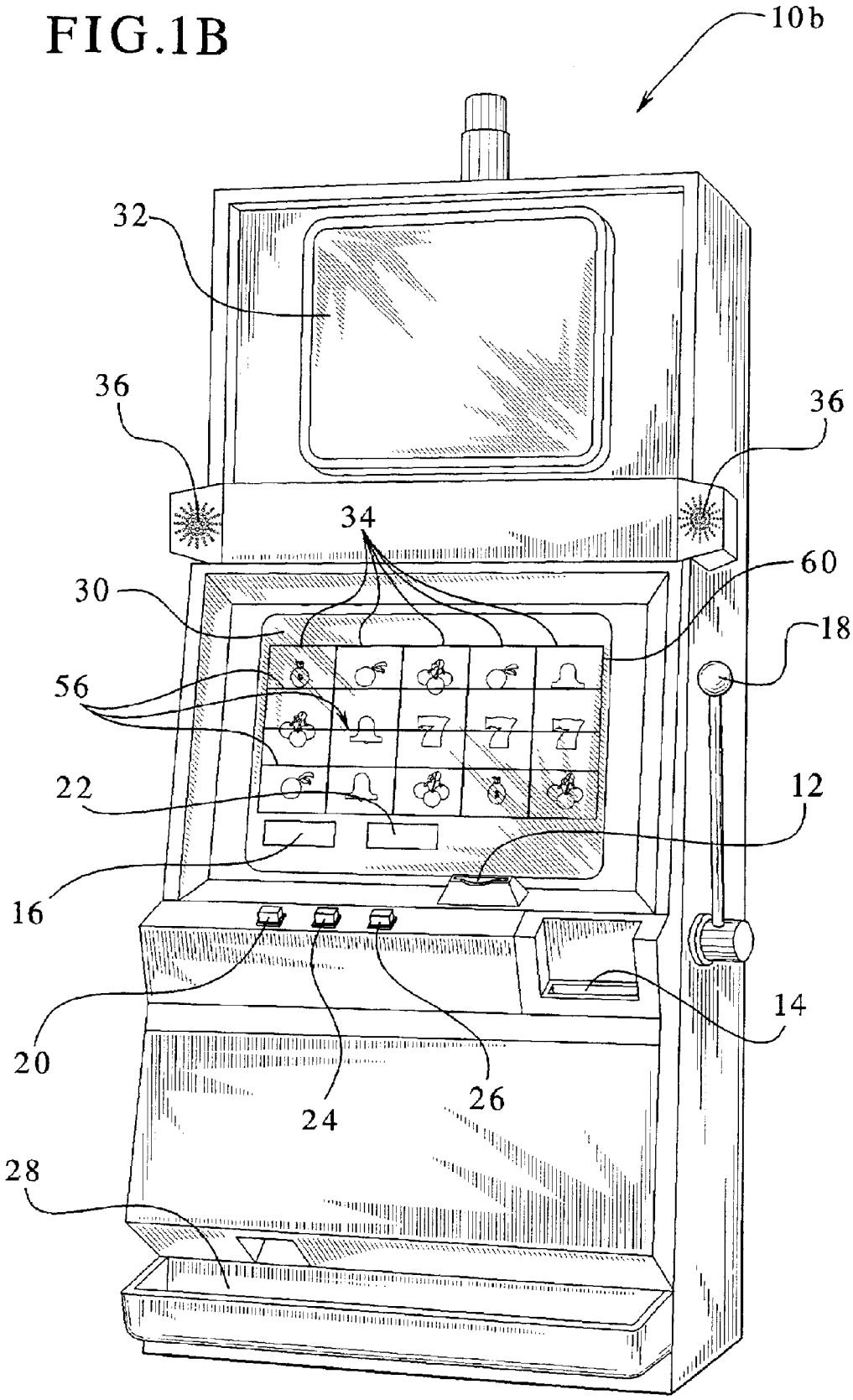
FIG. 1B is a front perspective view of another embodiment of the gaming device of the present invention which includes a refractive light display which functions as a payline associated with a plurality of reels.

Referring now to the drawings, two embodiments of the gaming device of the present invention are illustrated in FIGS. 1A and 1B as gaming device 10*a* and gaming device 10*b*, respectively. The gaming device of the present invention may be any gaming machine having the controls, displays and features of conventional gaming machines. It is constructed so that a player can operate it while standing or sitting. However, it should be appreciated that gaming device of the present invention can be constructed as a pub-style table-top game (not shown) which a player can operate preferably while sitting. Furthermore, gaming device can be constructed with varying cabinet and display designs, as illustrated by the designs shown in FIGS. 1A and 1B.

The gaming device can incorporate any base or primary game such as slot, poker, blackjack or keno, any of the bonus triggering events and any of the bonus round games. The symbols and indicia used on and in gaming device may be in mechanical, electrical, electronic or video form.

As illustrated in FIGS. 1A and 1B, the gaming device 10*a* or 10*b* includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device, a number of credits corresponding to the amount deposited is shown in a credit display 16. After depositing the appropriate amount of money, a player can begin the game by pulling arm 18 or pushing play button 20. Play button 20 can be any play activator used by the player who starts any game or sequence of events in the gaming device.

As shown in FIGS. 1A and 1B, gaming device also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device may employ other payout mechanisms such as credit slips redeemable by a cashier or electronically recordable cards which keep track of the player's credits.

The embodiment shown in FIG. 1A includes a central display device 30, a functional refractive light display 60 and a mechanical award wheel 64. The functional refractive light display 60 is positioned in front of the mechanical award wheel 64 as further discussed below.

The gaming device shown in FIG. 1B includes a central display device 30, an upper display device 32 and a functional refractive light display having paylines 56. Gaming device 10*b* includes a plurality of reels 34, and preferably three to five reels 34, in mechanical or video form on one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device. Furthermore, gaming device preferably includes speakers 36 for making sounds or playing music.

Figure 2:
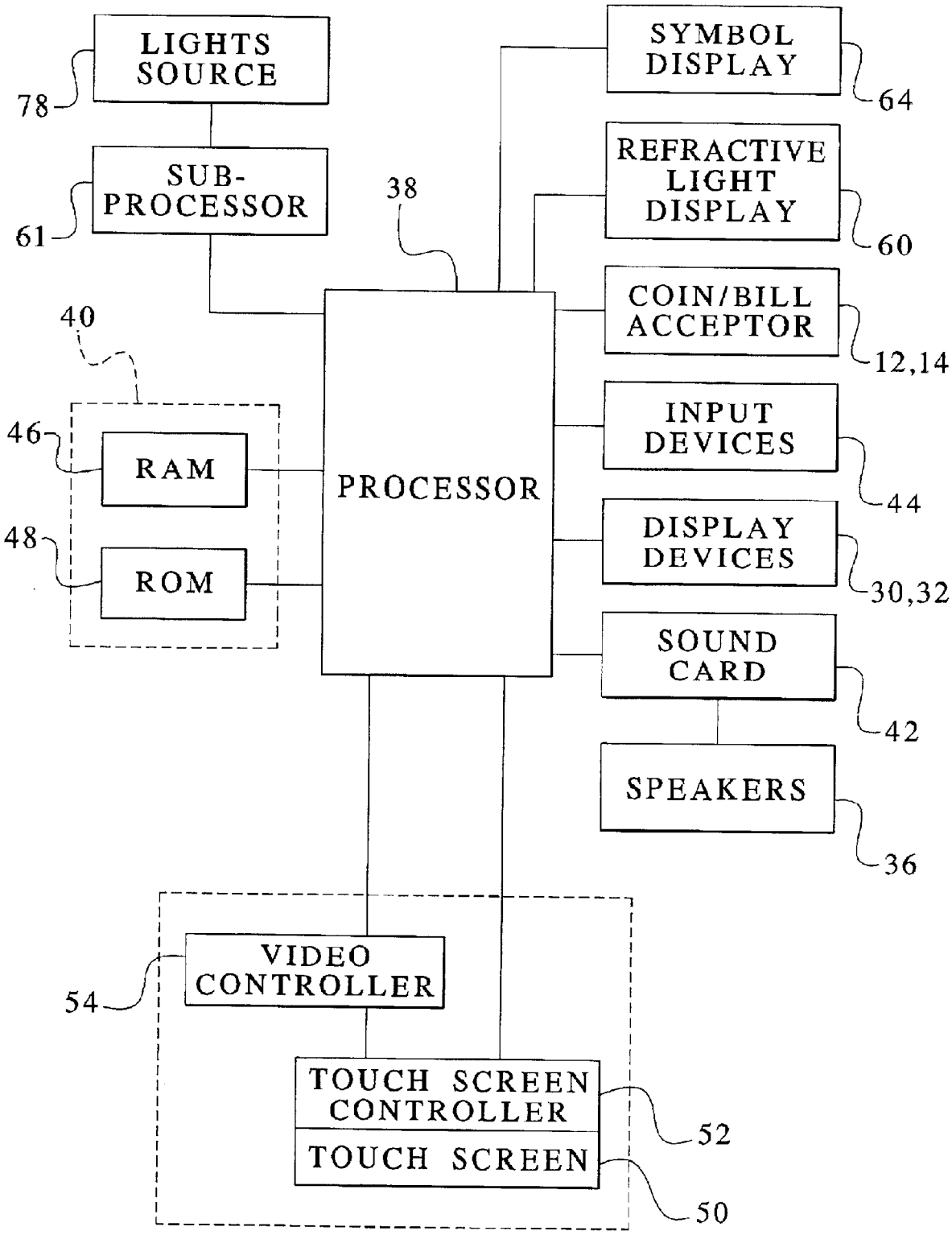
FIG. 2 is a schematic block diagram of the electronic configuration of one embodiment of the gaming device of the present invention.

As illustrated in FIG. 2, the general electronic configuration of one embodiment of the gaming device preferably includes: a processor 38; a memory device 40 for storing program code or other data; a central display device 30; an upper display device 32; a functional refractive light display 60 which may or may not be connected to the processor; a symbol display 64; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device so that it plays a particular game in accordance with applicable game rules and pay tables. In one embodiment of the present invention, the gaming device also includes a sub-processor 61 in communication with the processor 38 for controlling the light source 78 or lights of the light source.

As illustrated in FIG. 2, the player preferably uses the input devices 44, such as pull arm 18, play button 20, the bet one button 24 and the cash out button 26 to input signals into gaming device. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1A, 1B and 2, to operate the gaming device in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, in one embodiment the gaming device also gives players the opportunity to win credits in a bonus round. This type of gaming device will include a program which will generally automatically begin a bonus round when the player has achieved a qualifying condition in the game. This qualifying condition can be a particular arrangement of indicia on a display device. The gaming device may uses a video-based central display device 30 to enable the player to play the bonus round. In the slot embodiment, preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Functional Refractive Light Display

One embodiment of the present invention includes a functional refractive light display that is mounted in the gaming device for interacting with a game. In one embodiment, the functional refractive light display includes a sheet or layer of material (referred to herein as edge-lit material) having one or more refractive surfaces. The refractive surfaces are etched or otherwise suitably formed in the surface of the edge-lit material using a conventional etching device or other cutting tool. The edge-lit material is preferably acrylic; however, it should be appreciated that the edge-lit material of the refractive light display may be any other suitable transparent or translucent materials such as glass. It should also be appreciated that the edge-lit material may be molded, extruded or otherwise suitably formed with the refractive surfaces (and with reflective surfaces, areas or portions as discussed below).

In one embodiment, the light source is controlled by a sub-processor and includes a plurality of lights such as LED's mounted around the edge of the edge-lit material to direct light into the edge-lit material. It should be appreciated that any type of suitable light source may be used to direct light into the edge-lit material. The light emitted from the lights travels through the edge-lit material and is refracted from or directed out of the edge-lit material. One or more different patterns, images or designs may be formed in the edge-lit material by the refractive surfaces to interact with the game functionality or provide additional game functionality. The light refracted from the surfaces interacts or co-acts with the symbols on the symbol display to indicate one or more symbols or awards on the display, or indicate the game state or game mode to the player such as an attract mode, an idle mode, a normal mode, a game play mode, a bonus mode, cashout mode, a credit roll-up mode, a jackpot mode or other hand pay modes, or player tracking modes.

Figure 3:
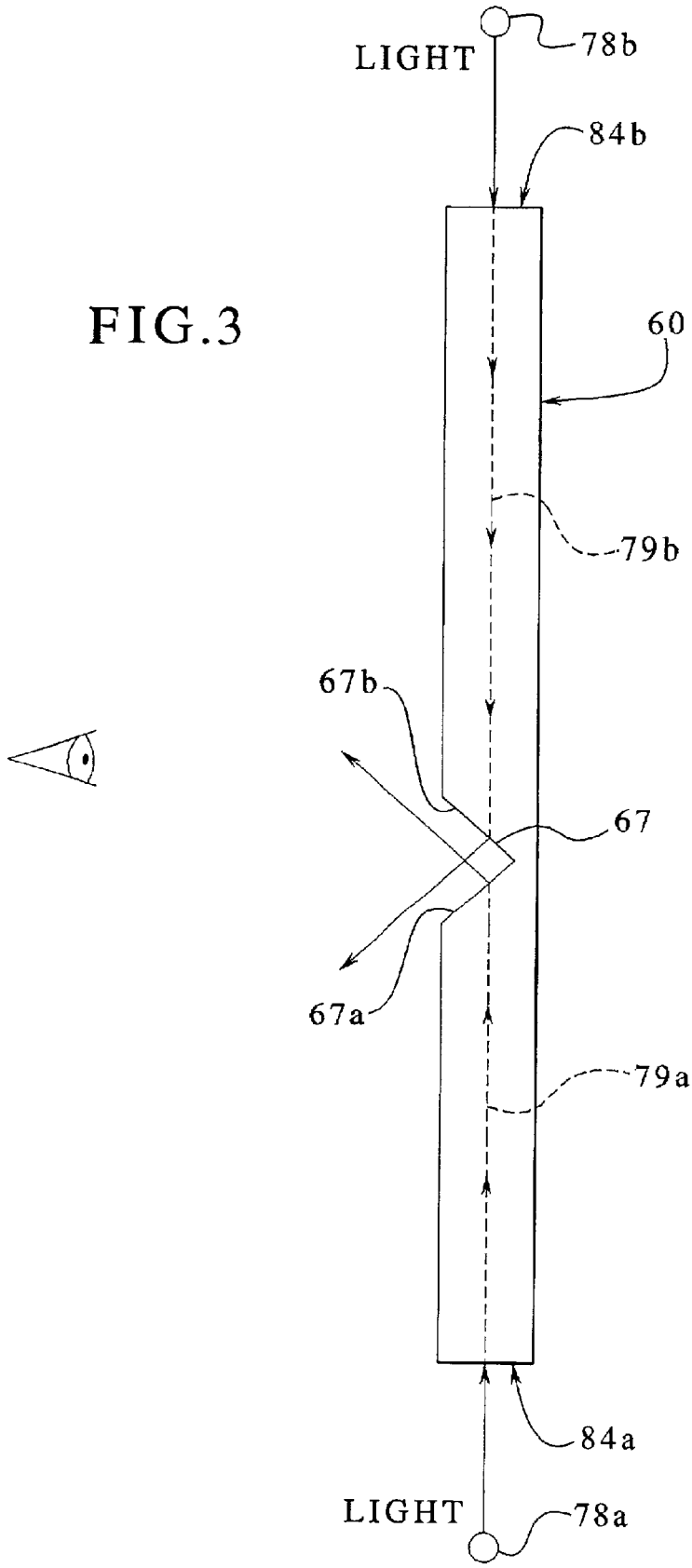
FIG. 3 is a side elevation view of a refractive light display of the present invention schematically illustrating how the light travels into edges of the display and is directed from the refractive surfaces.
Figure 4:
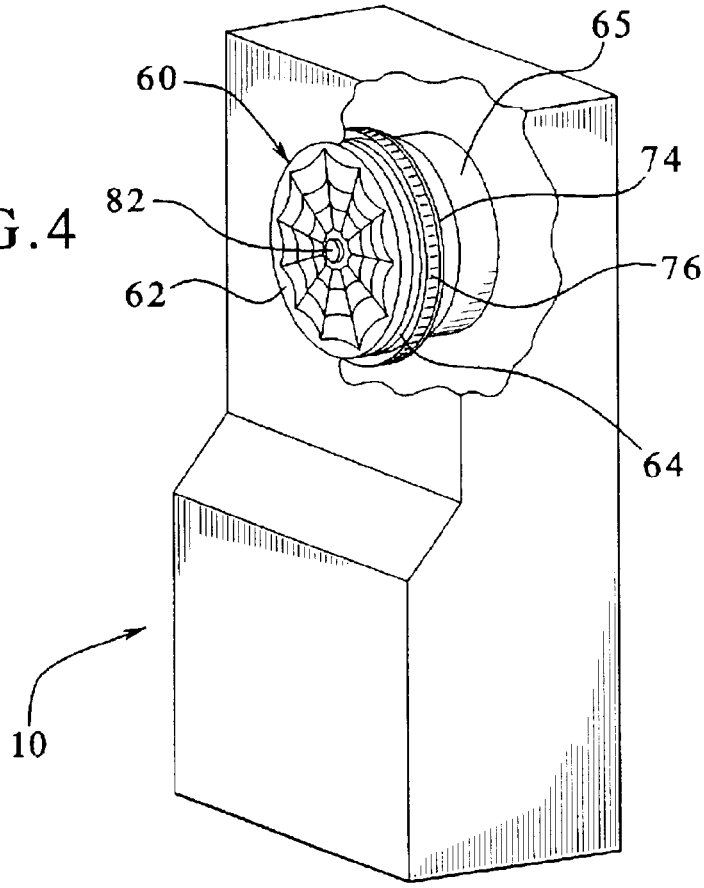
FIG. 4 is a perspective view of one embodiment of the present invention having a refractive light display and a mechanical award wheel symbol display.
Figure 5:
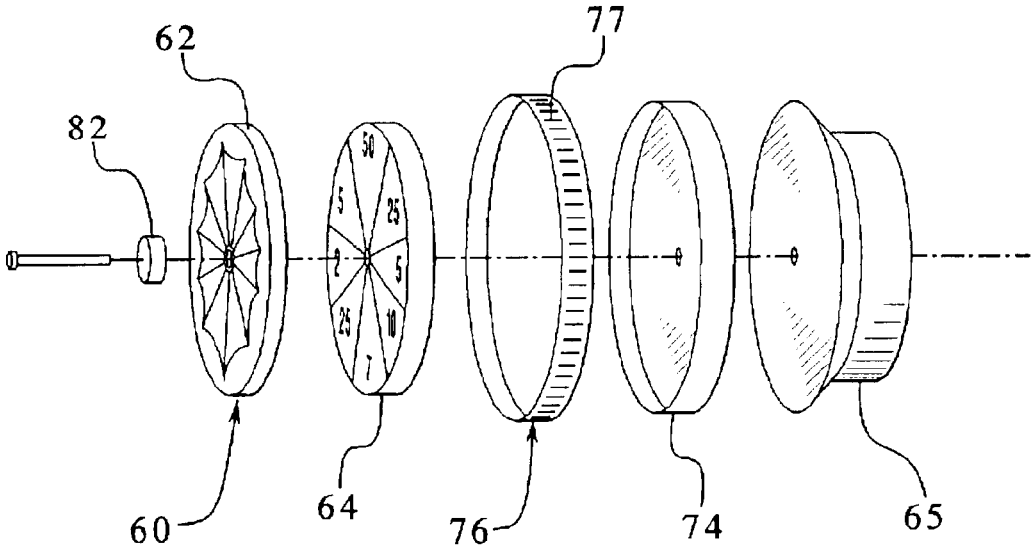
FIG. 5 is an exploded perspective view of the embodiment of the present invention illustrated in FIG. 4.
Figure 6B:
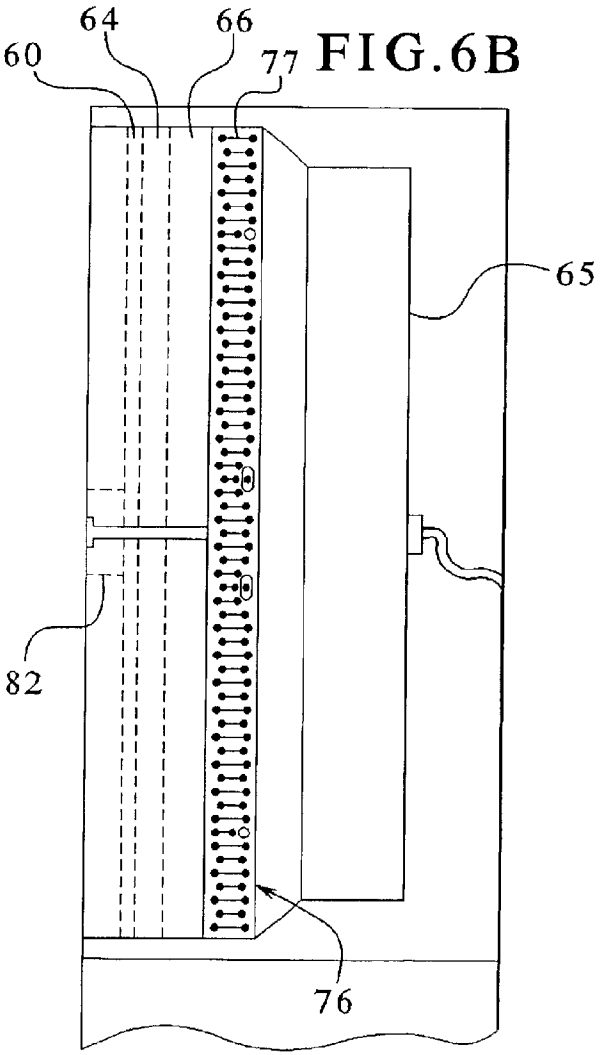
FIG. 6B is a side elevation view of the refractive light display shown in FIG. 6A.
Figure 6A:
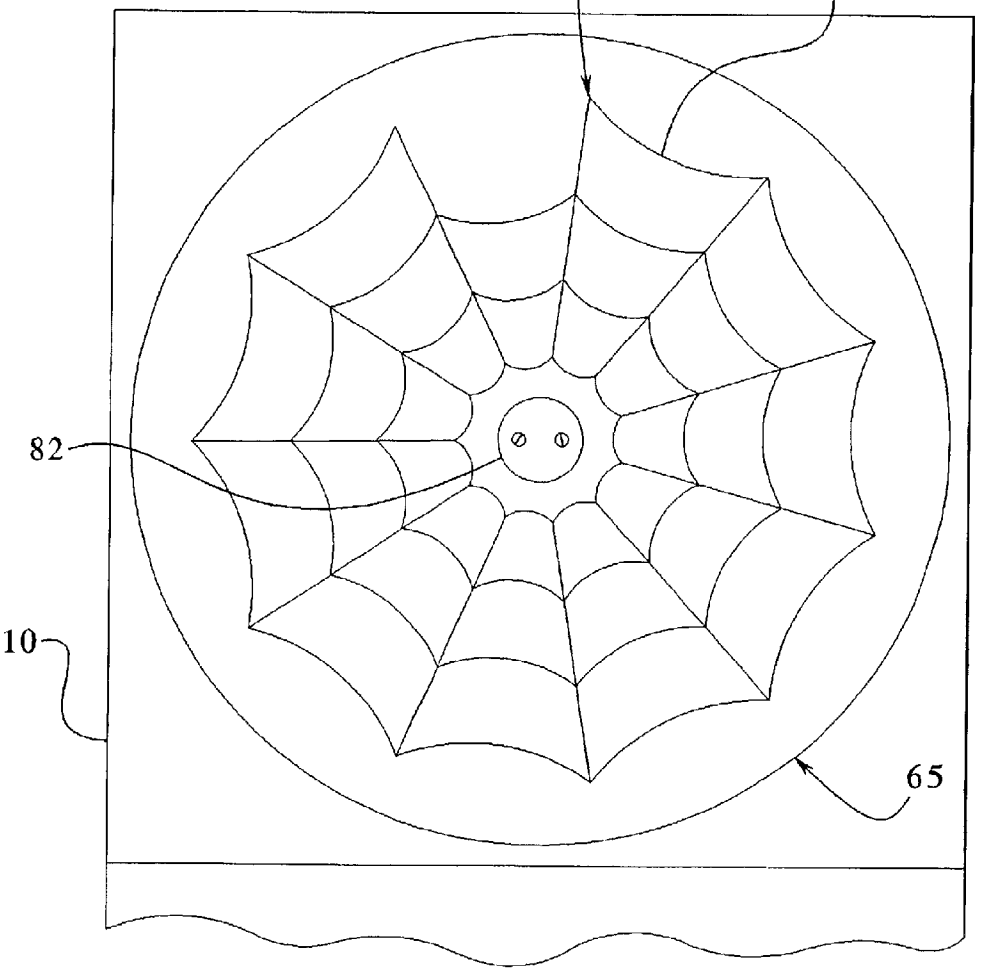
FIG. 6A is an elevation view of one embodiment of the present invention illustrating a refractive light display mounted to a gaming device.

Referring now to FIGS. 3 through 6B, light is directed into and through the refractive light display as illustrated in FIG. 3. A plurality of LEDs 78 are positioned along the outer edge of the refractive light display 60. Each LED 78 produces light which is directed into an edge 84 of the edge-lit material 62. The light travels through the edge-lit material as shown by the lines 79*a* and 79*b* drawn in phantom in FIG. 3. When the light traveling through the edge-lit material reaches the refractive surfaces 67*a* and 67*b*, which in this embodiment forms a V-shaped groove, the light is refracted at a predetermined angle based on the angle of the refractive surfaces 67. It should be appreciated that the angle of the refractive surfaces may be any angle desired depending on the lighting effect desired to be achieved in a game. It should also be appreciated that the refractive surfaces 67*a* and 67*b* may be any suitable size or shape depending on the desires of the game implementor. For instance, the refractive surfaces may be concave, convex or any other suitable shape which refracts light. The refracted light illuminates the patterns formed by the refractive surfaces in the edge-lit material, but not the non-refractive surfaces. In this manner, the player can see objects that are mounted behind the refractive light display 60 such as symbol displays and symbols thereon, award indicators or video display devices.

In one embodiment illustrated in FIGS. 4 through 6B, the functional refractive light display 60 includes edge-lit material 62 mounted in front of a mechanical award wheel 64 on gaming device 10. The edge-lit material 62 includes a plurality of refractive surfaces 67, which are arranged in a pattern to co-act with award symbols on the symbol display which is in the form of an award wheel. In this embodiment, the plurality of refractive surfaces 67 form a web pattern. The refractive light display 60 is positioned in front of the mechanical award wheel 64. The mechanical award wheel 64 has a plurality of pie-shaped sections 68. Each section 68 has an award symbol 70 or a bonus symbol 72. The refractive light display 60 and mechanical award wheel 64 are mounted in a housing 65. The housing 65 has a recessed area 66 adapted to receive the award wheel 64 and the refractive light display 60. A fastener such as a bolt, is inserted through corresponding openings in the refractive light display 60 and the award wheel 64 to secure the refractive light display 60 and the award wheel 64 to the housing 65. A fastening plate 82 is attached to the fastening device and further secures the refractive light display and award wheel 64 to the housing 65.

A cylindrical support bracket 74 is mounted on the outer surface of the housing 65. The light source including a plurality of lights is attached to light panels 76 which are attached or secured to the support bracket 74. Each light panel 76 includes a plurality of electric circuits 77 that are embedded in the light panels. Each embedded electrical circuit controls one or more lights such as LED's 78. The LED's 78 extend through the housing 65 and are positioned along the outer edge of the refractive light display 60. The light panel 76, embedded electric circuits 77 and LED's 78 are powered by a suitable electrical power source (not shown). The power source provides power through the associated circuits 77 to the LED's 78. The LED's 78 illuminate and direct light into the edge of the edge-lit material 62 of the refractive light display 60 as described above. The light panels 76 are connected by suitable wires and are adapted to be controlled in one embodiment by a sub-processor (shown in FIG. 2). The sub-processor 61 controls the light source and lights which activate at a given time or during a given time period in a game. The sub-processor does this in coordination with the function of the game controlled by the processor 38.

Figure 7:
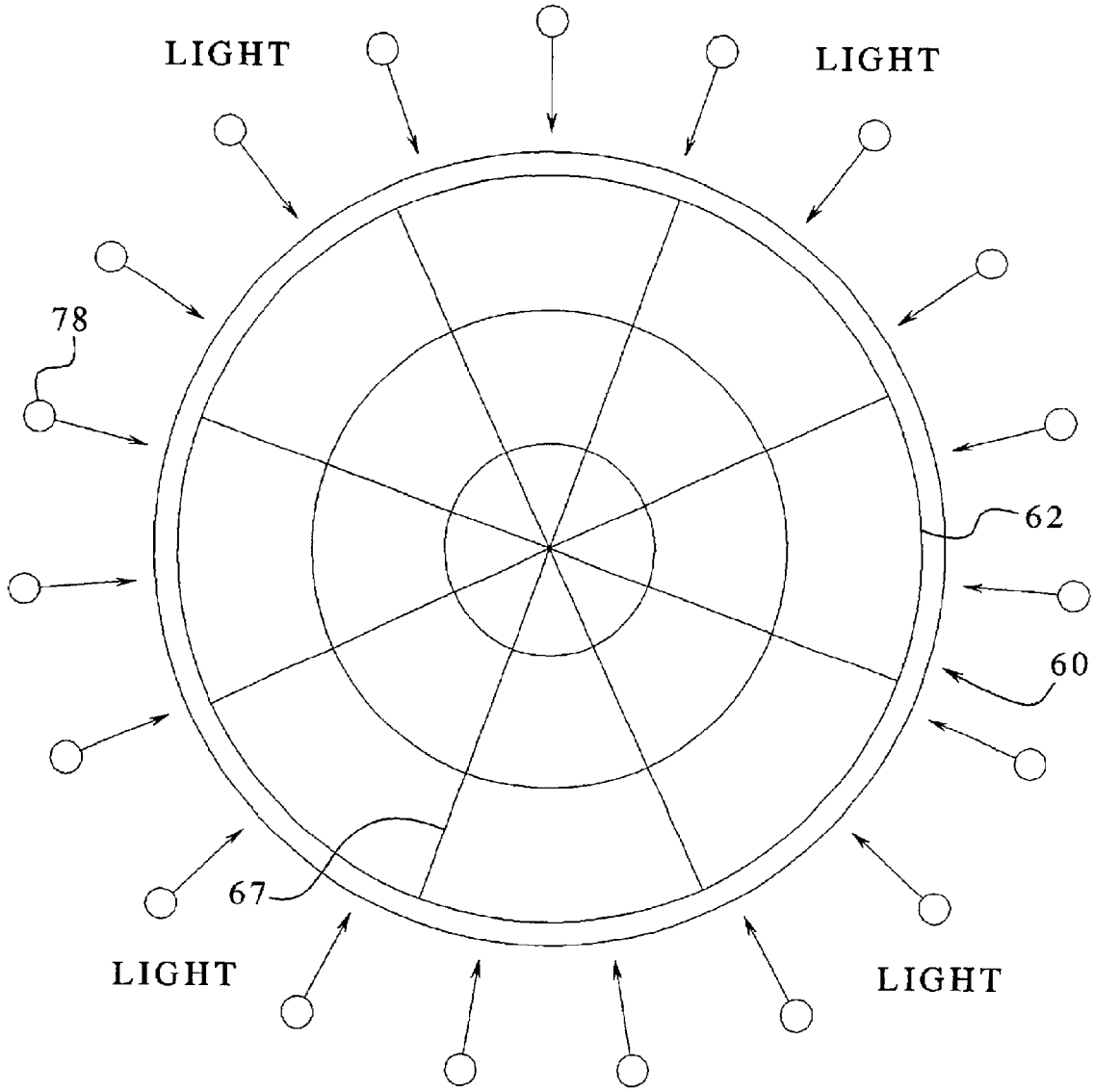
FIG. 7 is an elevation view of one embodiment of the present invention illustrating a refractive light display showing the direction of the light traveling into the display from one or more light sources.

Referring now to FIG. 7, one embodiment of the present invention is illustrated where LED's 78 direct light into the edge-lit material 62 in the refractive light display 60. The arrows indicate the direction that the emitted light travels into the edge-lit material 62. The emitted light travels through the edge-lit material 62 and is refracted from the refractive surfaces 67 that form the pattern in the edge-lit material. This provides the lighting effect viewed from the front of the refractive light display 60 wherein the light appears only in the areas of the refractive surfaces. The areas of the edge-lit material 62 in the refractive light display 60 without refractive surfaces do not appear illuminated and remain transparent or translucent to enable a player to see through those portions of the refractive light display 60. It should be appreciated that any color light source may be used to illuminate the refractive surfaces in the edge-lit material 62. It should also be appreciated that the edge-lit material 62 may be any color or colors as desired by the game implementor.

Figure 8B:
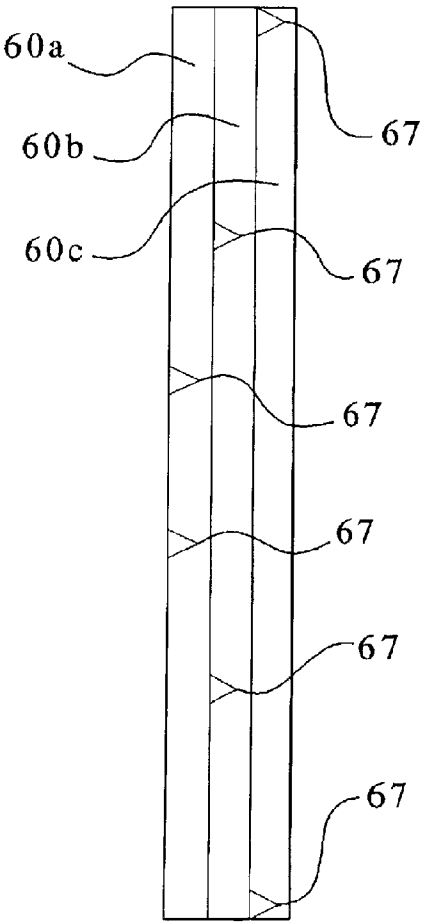
FIG. 8B is a side elevation view of the multiple refractive light displays of FIG. 8A.
Figure 8A:
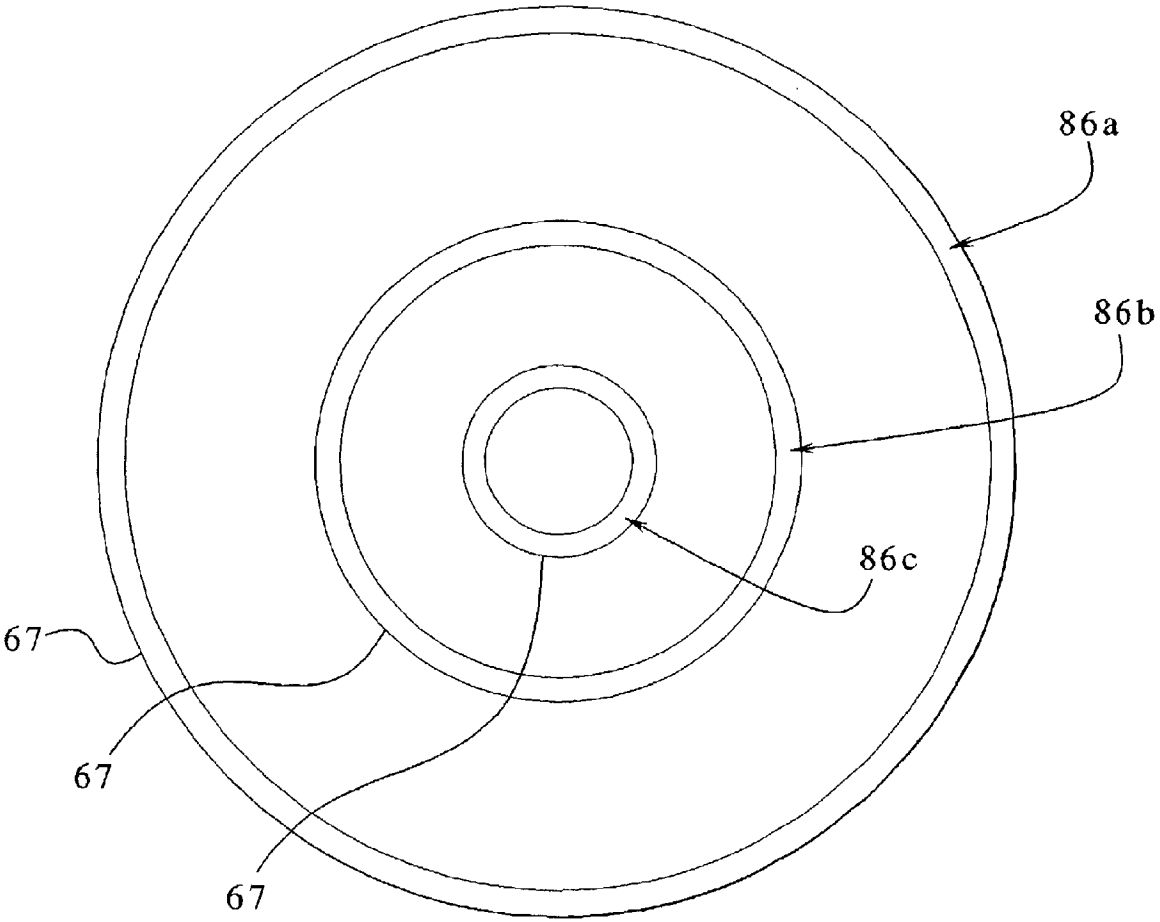
FIG. 8A is an elevation view of another embodiment of the present invention illustrating multiple adjacently positioned refractive light displays having co-acting refractive surfaces.

Referring now to FIGS. 8A and 8B, one embodiment of the present invention includes multiple refractive light displays 60*a*, 60*b*, and 60*c* having co-acting refractive surfaces 67. In the embodiment illustrated in FIGS. 8A and 8B, the multiple refractive light displays 60*a*, 60*b*, and 60*c* are individual pieces of edge-lit material 62 positioned adjacent to each other. In another embodiment, the co-acting refractive surfaces 67 are formed in a single piece of edge-lit material 62 by a suitable commercially available process. In a further embodiment, the refractive surfaces 67 are formed in separate layers or pieces of edge-lit material 62 and then formed or molded together to form a single refractive light display 60. In this embodiment, each refractive light display 60*a*, 60*b*, and 60*c* include cylindrical shaped refractive surface patterns having different diameters. The light is directed into the edge of each refractive light display and illuminates the refractive surfaces 67 in that refractive light display. A player sees the refracted light as three separate circular rings 86*a,* 86*b* and 86*c*. The non-refractive areas or the areas between the rings 86*a,* 86*b* and 86*c* do not refract light and therefore these areas are not illuminated, but remain transparent or translucent to the player.

Furthermore, different color lights can be used to generate different pattern colors. The different color light sources enable a game implementor to highlight or focus a player's attention to a particular section or area in a game, or to a particular game state or mode as described above. It should be appreciated that any color light and any combination of colors (displayed simultaneously, sequentially or alternately) may be used to illuminate the edge-lit material 62.

In another embodiment of the present invention, different color lights in the light sources are used to make a refractive light display appear as if it is rotating or moving in front of a player. The light sources direct the light into the refractive light display to create a visual movement effect. This effect is created by alternately illuminating different color lights adjacent to the display. The light source and the individual lights are controlled by a sub-processor of the gaming device in accordance with the play of the primary game or secondary game.

Figure 9B:
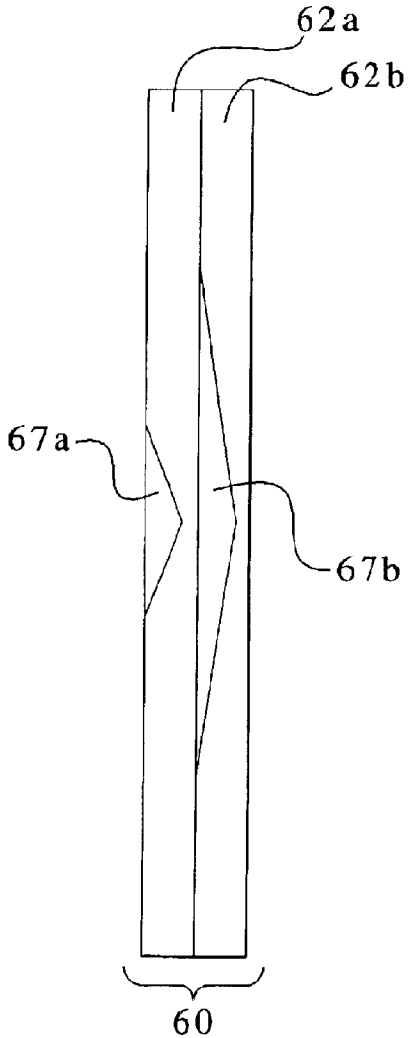
FIG. 9B is a side elevation view of the multiple refractive light displays of FIG. 9A illustrating the multiple refractive surfaces which form a refracted image created by superimposing separate refractive surfaces.
Figure 9A:
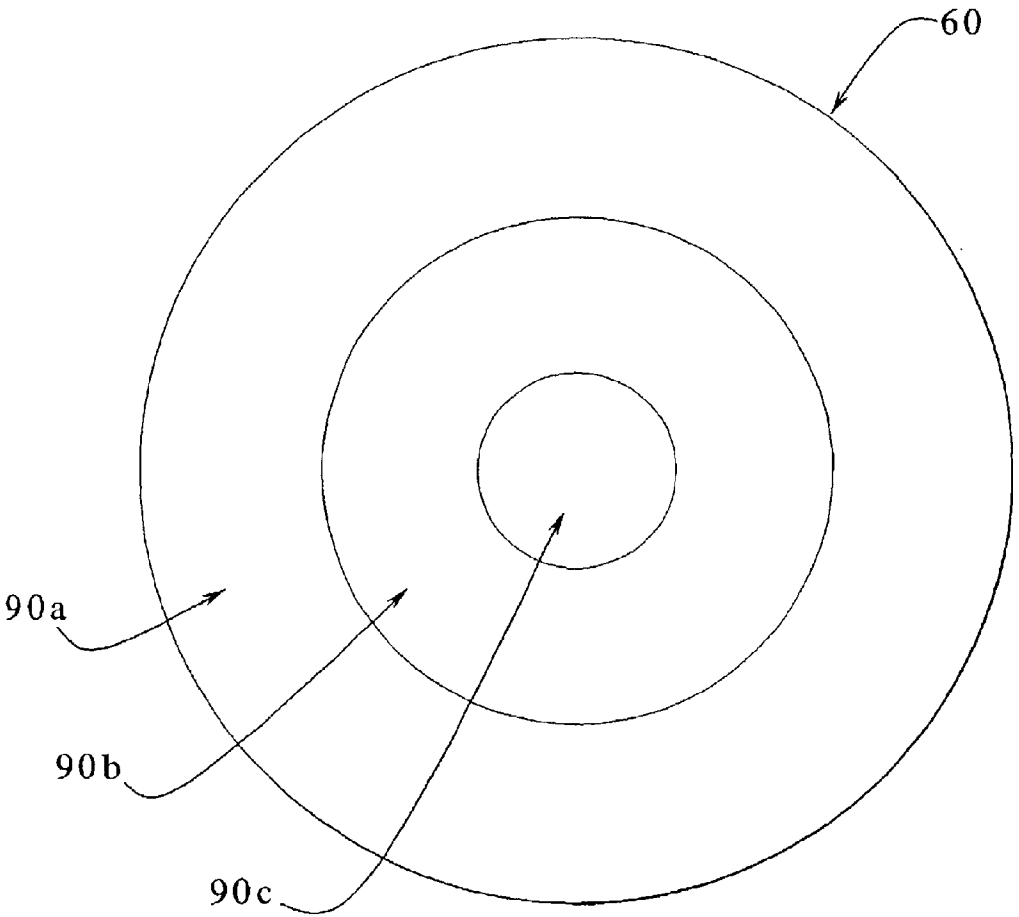
FIG. 9A is a front elevation view of another embodiment of the present invention illustrating multiple refractive light displays having co-acting refractive surfaces.

Referring to FIGS. 9A and 9B, another embodiment of the present invention is illustrated where a refractive light display 60 illuminates circular areas in a game. In this embodiment, two pieces of edge-lit material, 62*a* and 62*b,* are used to form the patterns on the functional refractive light display 60. The pieces of edge-lit material 62*a* and 62*b,* are formed or molded together to create the refractive light display 60. The patterns or concentric circular areas 90*a,* 90*b,* and 90*c* are illuminated and shown by forming elongated, v-shaped refractive surfaces 67*a* and 67*b* in adjacent layers of edge-lit material 62*a* and 62*b*. It should be appreciated that the refractive surfaces may be any size or shape including but not limited to, a convex shape, concave shape, groove or other shapes. Light is directed into each piece of edge-lit material 62*a* and 62*b* in the refractive light display 60 to illuminate the refractive areas 67*a* and 67*b*. In this embodiment, an entire circular refractive area such as area 90*a,* 90*b* or 90*c,* is illuminated by the light from the light sources. One color of light may be used or several different colors of light may be used to illuminate each circular area 90*a,* 90*b,* and 90*c*. In this manner, a game implementor can alternate or combine colors in a game to highlight certain areas or game modes on the gaming device to provide the primary or secondary game.

Figure 10:
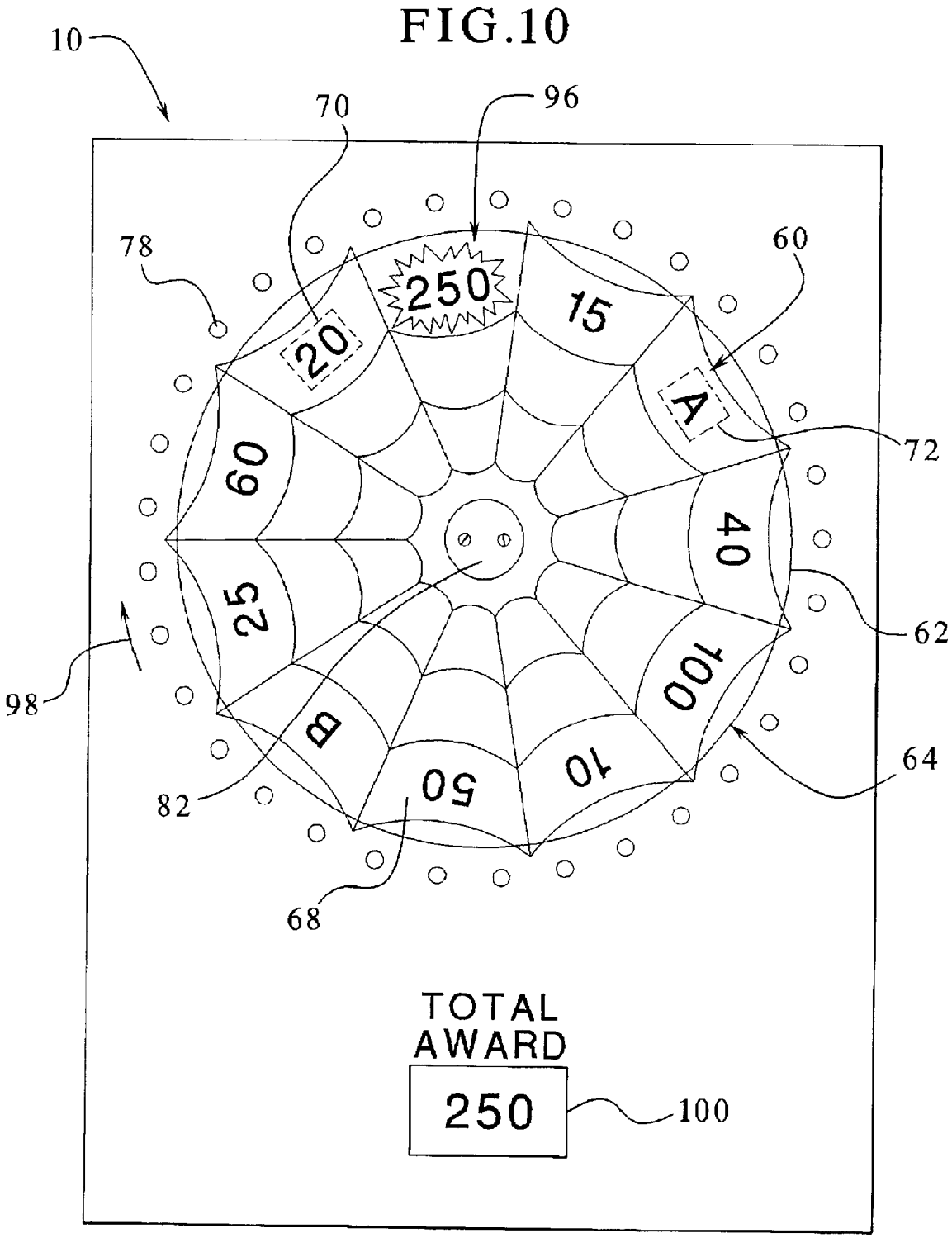
FIG. 10 is a front elevation view of a further embodiment of the present invention illustrating a refractive light display mounted on a gaming device having a mechanical award indicator symbol display.

Referring now to FIG. 10, a further embodiment of the present invention is illustrated where the refractive light display 60 is secured to a gaming device to function in a primary game or secondary game. In this embodiment, the edge-lit material 62 includes refractive surfaces that form a web pattern in the edge-lit material. The refractive light display 60 is connected to the front of and adjacent to an award wheel 64. The award wheel 64 includes a plurality of award symbols 70 and bonus symbols 72. In this embodiment, the refractive light display 60 does not include refractive surfaces in the open section 96. The open section 96 highlights or indicates an award symbol 70 on the award wheel 64. Therefore, the refractive light display 60 indicates symbols on the award wheel in the bonus game. It should be appreciated that the award indicator can be a pointer, barrier, box, area, payline or other suitable indicator. It should also be appreciated that the refractive light display 60 may also be used to indicate a game state or mode as indicated above.

In one embodiment, the functional refractive light display 60 remains stationary while the award wheel 64 rotates in a clockwise direction as shown by arrow 98. In another embodiment, the functional refractive light display 60 moves or rotates while the award wheel 64 remains stationary. It should be appreciated that the functional refractive light display 60 may rotate, the award wheel 64 may rotate, or both the refractive light display and award wheel may rotate simultaneously. It should also be appreciated that the functional refractive light display 60 and the award wheel 64 may rotate in a clockwise direction, a counterclockwise direction or alternately rotate where the award wheel and the refractive light display rotate in the same direction or in opposite directions. It should also be appreciated that the color of light used to light the edge-lit material may change as the light source or retractive light display moves or rotates. In this embodiment, the functional refractive light display 60 is used in a game or bonus game to highlight or indicate an award on the award wheel 64. The award wheel 64 is rotated by a player or the gaming device. As the award wheel 64 rotates, the functional refractive light display 60 is illuminated in a particular color as desired by the game implementor. Once the award wheel 64 stops spinning, the removed section 96 of the functional refractive light display 60 indicates the award obtained by the player. In this example, the player obtained an award of two hundred fifty. The award of two hundred fifty is transferred to the total award display 100 as indicated.

In another embodiment, a symbol on the award wheel 64 is indicated by illuminating a single section on the award wheel. A single section can be illuminated by positioning one light source along one part of the award wheel. Therefore, the light source only directs light into the particular section that passes or rotates past the light source and only that section is illuminated on the award wheel. The award associated with the award symbol indicated or highlighted by the illuminated section when the award wheel stops spinning is the award that is provided to the player. It should be appreciated that the light source may be positioned adjacent to any section on the award wheel. It should also be appreciated that one or more sections may be illuminated at one time or that one or more colors of light may be used to illuminate one or more sections on the award wheel at a time.

Figure 11:
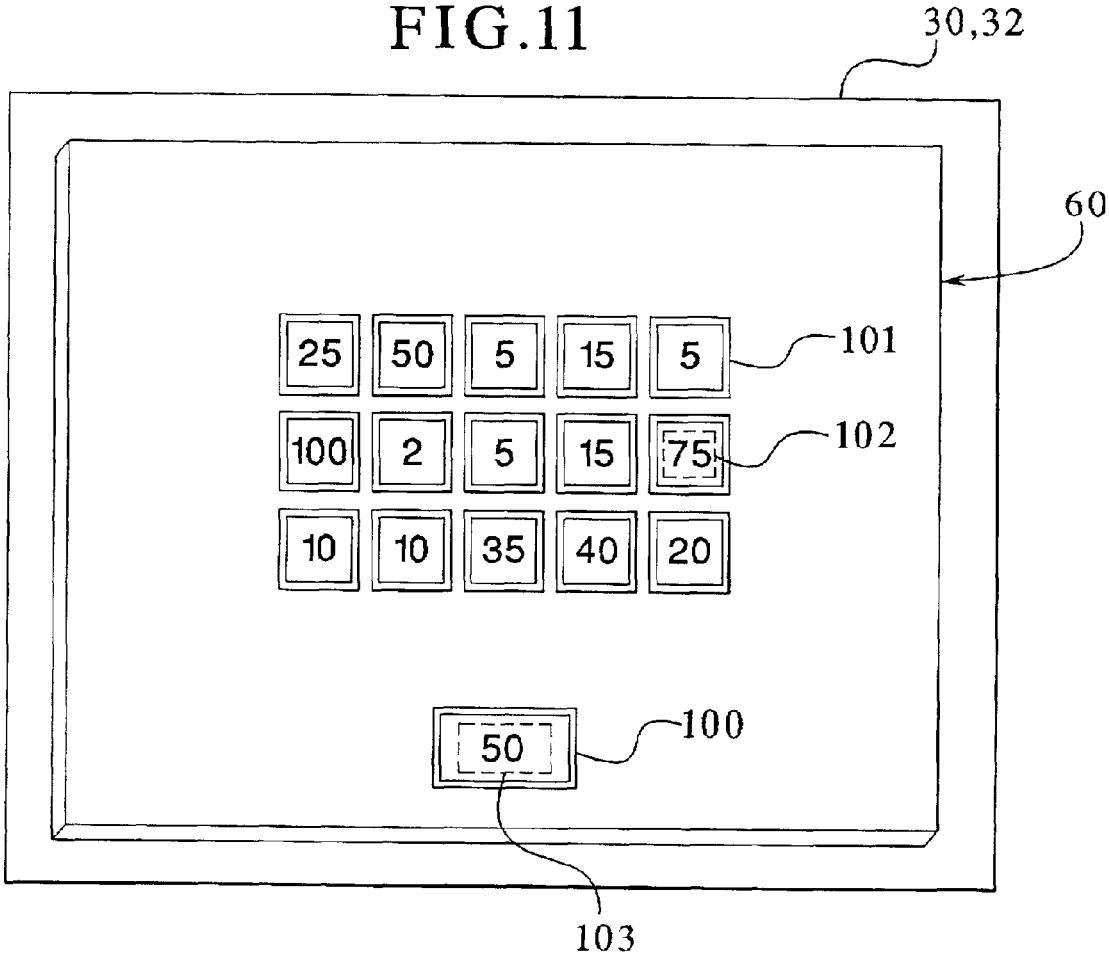
FIG. 11 is a front elevation view another embodiment of the present invention illustrating a refractive light display which includes a plurality of selections and associated award symbols.

Referring now to FIG. 11, a further embodiment is illustrated where the refractive light display 60 includes refractive surfaces that form player selectable selections 101 and award symbols or awards 102. The refractive light display 60 is positioned adjacent to a display device 30 or 32 in a gaming device 10. In this embodiment, the refractive surfaces in the refractive light display 60 form the selections 101. It should be appreciated that the selections 101 may be any shape or symbol desired in a game. The refractive surfaces also form the award symbols 102 in the refractive light display. Additionally, the total award display 100 and total award 103 indicated by the total award display are refractive surfaces formed in the refractive light display. It should be appreciated that the selections, award symbols, total award display and total award may be formed with refractive surfaces, displayed on a display device 30 or 32, formed with refractive surfaces and displayed on a display device or any combination therein. It should also be appreciated that in a game or bonus game, the selections may be formed by refractive surfaces and the award symbols displayed on the display device 30 or 32, the award symbols may be formed by refractive surfaces and the selections displayed on the display device 30 or 32 or any combination therein. It should be appreciated that a symbol or game mode may be indicated by different lighting effects such as flashing the light, cycling the light, alternately directing the light, sequentially directing the light, or simultaneously directing the light into the edge-lit material. It should also be appreciated that the same color or different color lights may be used in conjunction with the lighting effects described above.

In one embodiment, the refractive light display has refractive surfaces that form the selections 101 as illustrated in FIG. 11. The award symbols 102 are displayed by the display device 30 or 32. In a game or bonus game using this embodiment, the gaming device illuminates the selections 101 and the total award display 100 with light from one or more light sources (not shown) positioned adjacent to the edge-lit material 62 in the refractive light display 60. The selections 101 and the total award display 100 may be illuminated with the same color light, different color lights or any combination desired by the game implementor. Preferably, the award symbols 102 are masked or hidden at the start of the game. The player is prompted to pick a selection 101 from the plurality of selections. After the player picks a selection 101, the gaming device illuminates that selection with a different color to indicate that the selection was picked by the player.

The player can be prompted by flashing the light or lights directed into the refractive light display so that the selections flash in front of the player. A message such as "Pick a Selection" may be formed with refractive surfaces and illuminated on a refractive light display. Furthermore, a message may be displayed on a display device 30 or 32 to prompt a player to pick a selection. Any of these methods of prompting a player to pick a selection or any combination of these methods may be used in a game or bonus game to prompt a player.

The picked selection may be illuminated with a different color by displaying a different color in the background of the picked selection, which is on the display device 30 or 32. The picked selection may also be illuminated or highlighted by including a reflective material as further discussed below. The different color light from the light used to illuminate the other selections is directed towards the surfaces having the reflective coating and is reflected into the picked selection to illuminate only that selection. It should be appreciated that one selection, a plurality of selections or all of the selections may be illuminated as described.

In a further embodiment, the award symbols 102 are letters or other symbols that are associated with an award. The selections 101 and associated award symbols 102 are formed with refractive surfaces in a refractive light display 60. Light is directed into the edge-lit material 62 of the refractive light display 60 and illuminates the refractive surfaces that form the selections 101 and award symbols 102. The selections 101 and award symbols 102 may be illuminated with the same color of light or different colors of light as desired by the game implementor. In this embodiment, a player picks a selection 101 associated with an award symbol 102 and receives the award associated with the picked award symbol. In one embodiment, the player uses a mechanical selector for picking the selections. A different color light is used to indicate that the player selected a particular selection and award symbol in a game or bonus game.

Furthermore, the award symbol 102 associated with the picked selection is revealed to the player. In one embodiment, the display device 30 or 32 displays the award symbol 102 associated with the picked selection. In another embodiment, the award symbols 102 are formed from refractive surfaces and are revealed by illuminating the refractive surfaces that form the award symbol associated with a picked selection. The award symbol 102 associated with the picked selection may be illuminated with the same color light or with a different color light. In one embodiment, the selections 101 and the award symbols 102 are formed from refractive surfaces in one refractive light display 60. The selections 101 and the award symbols 102 are refractive surfaces having a reflective material such as a reflective coating that reflects light into the selections such that one or more selections and associated award symbols may be illuminated at a particular time in a game. In another embodiment, the selections 101 are formed with refractive surfaces in one refractive light display and the award symbols 102 are formed with refractive surfaces in another adjacent refractive light display. It should be appreciated that a single refractive light display having multiple layers of edge-lit material, as illustrated in FIGS. 8A, 8B, 9A and 9B, may be used to illuminate the selections 101 and the award symbols 102.

After a player picks a selection 101 and obtains the associated award symbol 102, the award indicated by the award symbol is transferred to the total award display 100. The total award display 100 and associated total award 103 may be formed from refractive surfaces in a refractive light display or displayed on a display device 30 or 32. In one embodiment, the total award display 100 is formed with refractive surfaces and the total award 103 is displayed on a display device. In another embodiment, the total award display 100 is displayed on a display device and the total award 102 is formed with refractive surfaces. In other embodiments, any combination of refractive surfaces in a refractive light display or images displayed on a display device may be used to show the total award display and associated total award. It should be appreciated that any type of display associated with a game or bonus game such as a spin display or an award display may be formed with refractive surfaces in a refractive light display.

Figure 12:
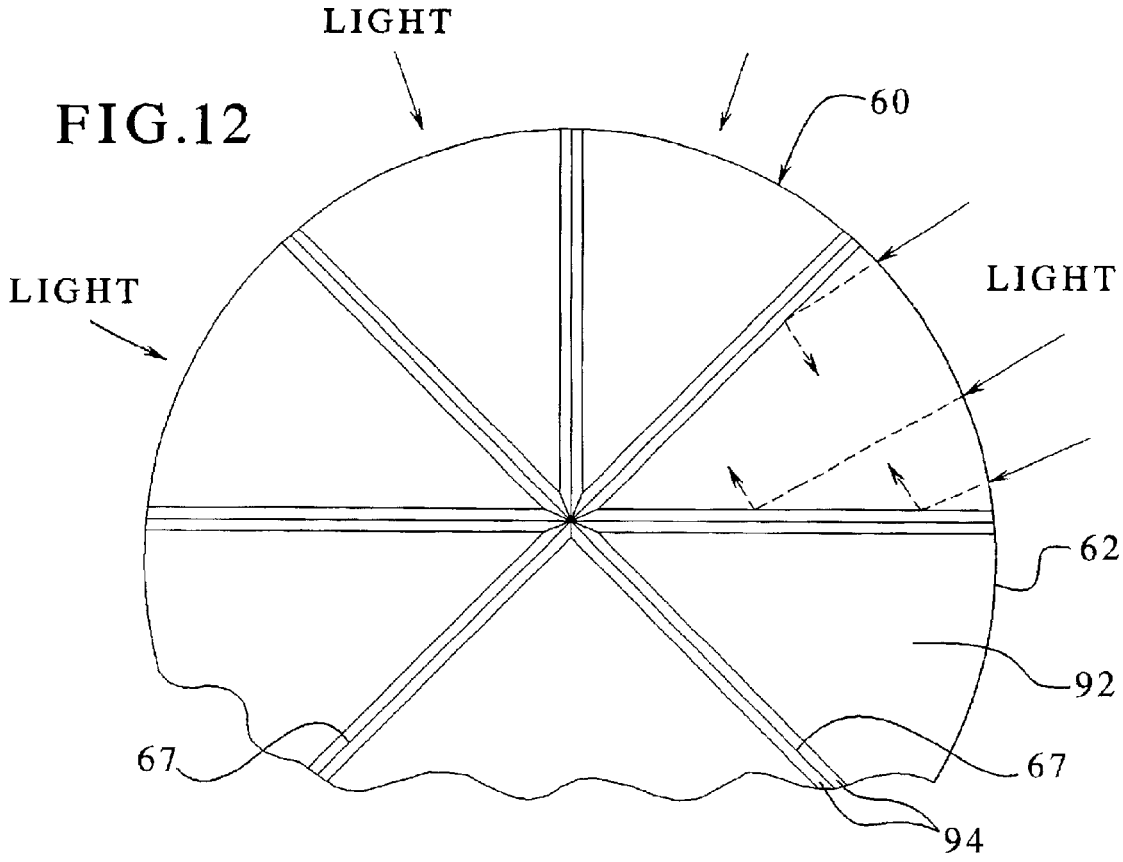
FIG. 12 is a fragmentary elevation view of another embodiment of the present invention illustrating a sectional refractive light display having multiple sections, wherein each section includes a reflective coating which prevents the light from traveling to an adjacent section.
Figure 13:
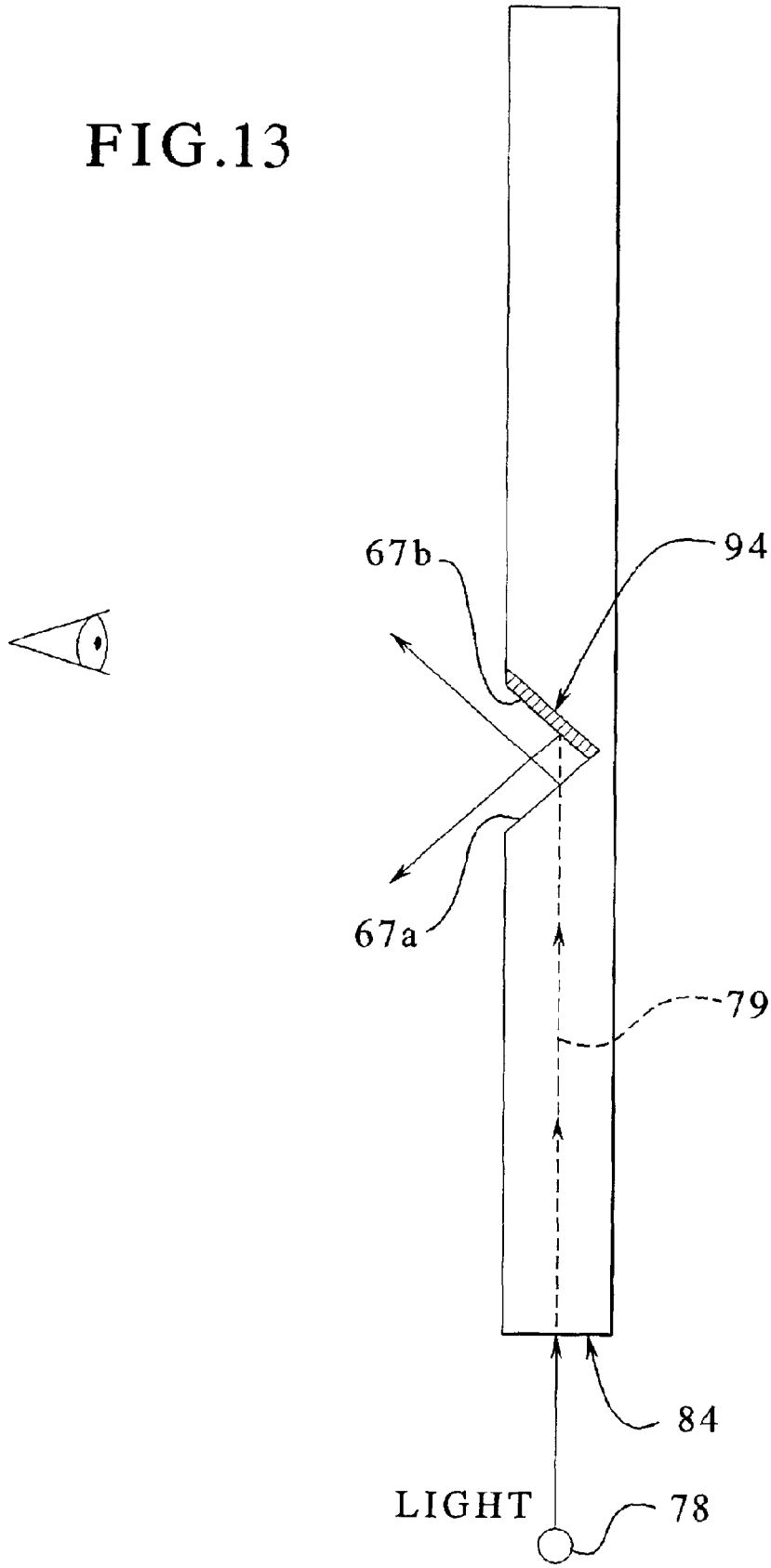
FIG. 13 is a side elevation view of the refractive light display of an alternative embodiment of the present invention schematically illustrating how the light travels into edges of the display and is directed from the refractive surfaces and reflects from a reflective layer illustrated in FIG. 14.

Referring now to FIGS. 12 and 13, a further embodiment of the present invention is illustrated where the refractive light display includes a plurality of wedge or pie-shaped sections 92. The sections 92 are separated by reflective layers 94. The reflective layers 94 are formed from a reflective material such as aluminum tape or a reflective coating such as a metallic paint. It should be appreciated that the reflective material may be any suitable reflective material such as metallic paints, metallic tapes or other reflective coatings and materials. In one embodiment, the refractive light display 60 may be manufactured with the refractive surfaces 67 and the reflective layers 94 formed in a single piece of edge-lit material 62 such as a single piece of acrylic with the reflective coatings or layers formed in the acrylic in any suitable desired pattern. In another embodiment, the sections 92 are separate components and the reflective layers 94 are inserted between the sections as the refractive light display 60 is being manufactured. In a further embodiment, the refractive light display 60 is manufactured and then the reflective layers 94 are placed or inserted onto the refractive surfaces 67.

A light source 78 directs light 79 into an edge 84 of a piece of edge-lit material 62. The light travels through the edge-lit material and refracts from refractive surface 67*a*. The reflective layer 94 formed on refractive surface 67*b* reflects the light 79 that is traveling through the edge-lit material 62 instead of refracting it. Therefore, the light enters one or more sections 92 and remains in a particular section because the reflective material or coating of the reflective layer 94 reflects the light back into each section as shown in FIG. 12. The light does not pass through the reflective coating. Thus, a particular section or sections may be illuminated by refracting the same color or different color light out of each section. A single section may also be illuminated to highlight a particular part of a game or particular game mode in a gaming device. It should be appreciated that the reflective material or coating may be used to separate any type of areas, sections, segments or other components of a refractive light display having various sizes and shapes as desired by the game implementor. It should also be appreciated that a refractive light display may include two refractive surfaces where one of the surfaces is coated with a layer of reflective material as illustrated in FIG. 13. The light directed into the edge-lit material refracts out of the surface towards a player. Also, some of the refracted light refracts towards the reflective layer which reflects the light towards the player.

Figure 14:
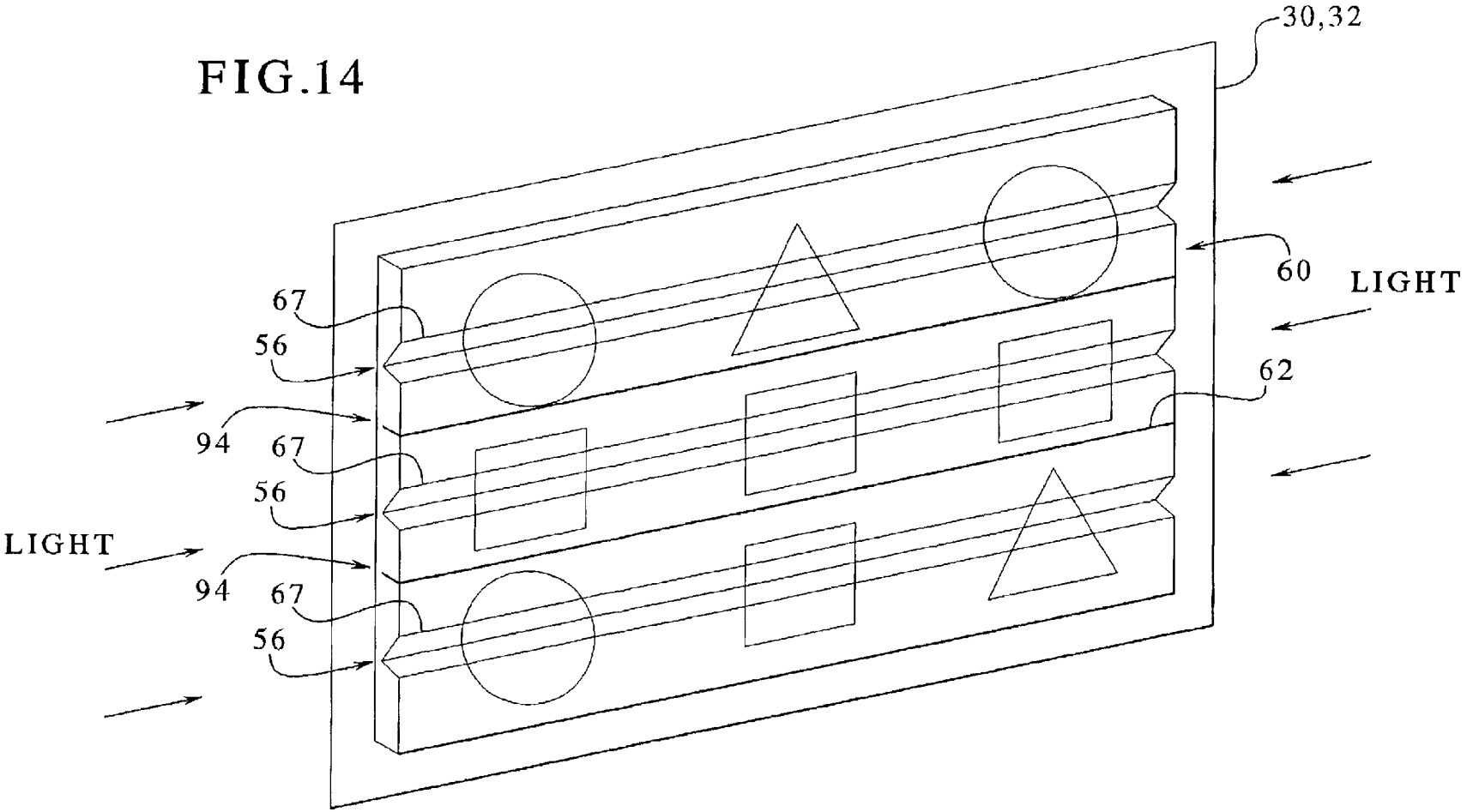
FIG. 14 is a side perspective view of another embodiment of the present invention illustrating a refractive light display which illuminates a plurality of paylines in a gaming device.

Referring now to FIG. 14, a further embodiment of the present invention is illustrated where the paylines 56 of a gaming device are displayed on a refractive light display 60. In this embodiment, the display includes three paylines 56 in a single piece of edge-lit material 62. It should be appreciated that any number of paylines may be formed in a refractive light display 60. The paylines 56 may be horizontal, vertical, diagonal, or any combination thereof and formed in the functional refractive light display 60. Each payline 56 is formed from a refractive surface 67 in the edge-lit material 62. Light sources having lights or LED's are positioned or mounted along the left and right sides of the display or along any side or combinations of sides in the display. One or more reflective layers 94 are preferably formed in the edge-lit material to separate the light directed to each payline and thus allow each payline to be separately illuminated. It should be appreciated that the reflective layers 94 may not be necessary if only one payline is present or if separate refractive light displays are used for each payline. The sub-processor 61 controls the lights 78 to illuminate a single payline 56 or multiple paylines as desired by the game implementor. Also the paylines 56 may be illuminated with different colors so that one of the colors may be used to indicate a winning symbol, symbol combination or jackpot combination in a game, or one or more game modes.

Figure 15B:
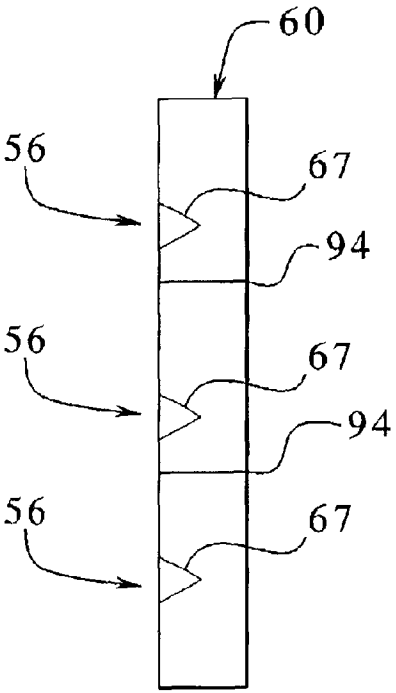
FIG. 15B is a side elevation view of the paylines formed by the refractive light display FIG. 13A which further illustrates the direction that the light travels in the display.
Figure 15A:
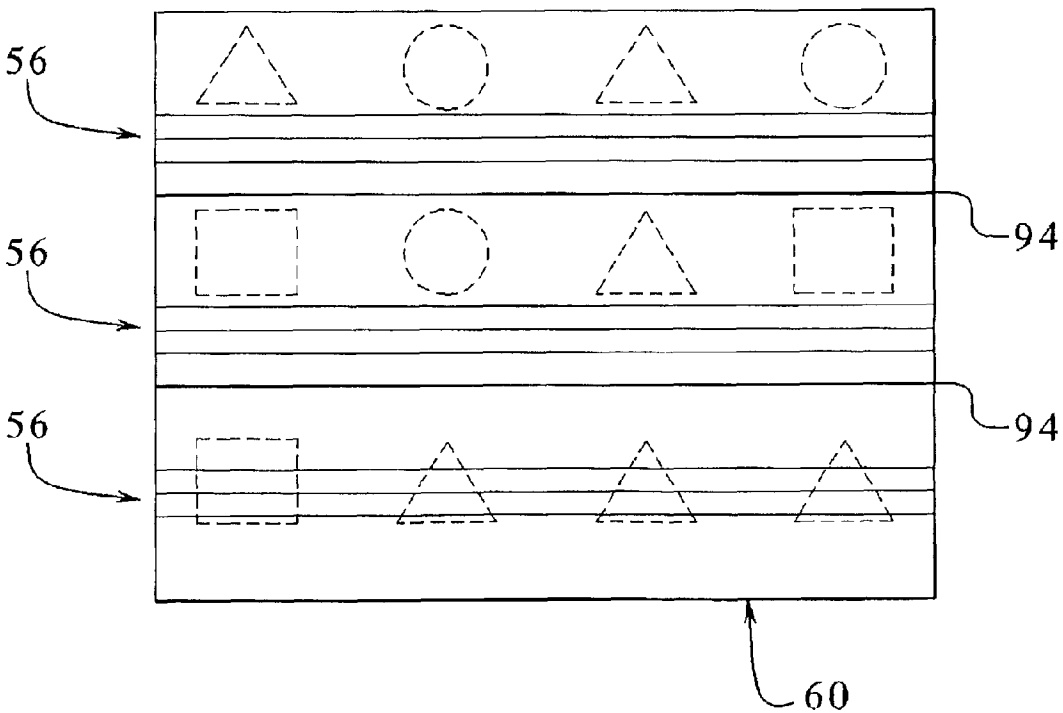
FIG. 15A is an elevation view of the paylines formed by the refractive light display of FIG. 12.

Referring now to FIGS. 15A and 15B, a side view of the embodiment shown in FIG. 14 illustrates how the refractive surfaces 67 form the paylines 56 in the functional refractive light display 60. A light source (not shown) including a plurality of LED's illuminates or creates light that is directed into the edge-lit material 62 of the functional refractive light display 60. The light travels until it meets a refractive surface 67 that forms a payline 56. The light then refracts from the refractive surface 67 and illuminates the refractive surface 67. The reflective material or layers 94 prevents light from illuminating other refractive surfaces in the edge-lit material. A player views the refracted light from the paylines 56 but does not view light from the non-refractive surfaces or areas. Thus, the display 60 illuminates the paylines 56 to the player. Furthermore, the edge-lit material 62 is transparent so that the player is able to view the award symbols and associated reels adjacent to and behind the refractive light display 60.

Figure 16:
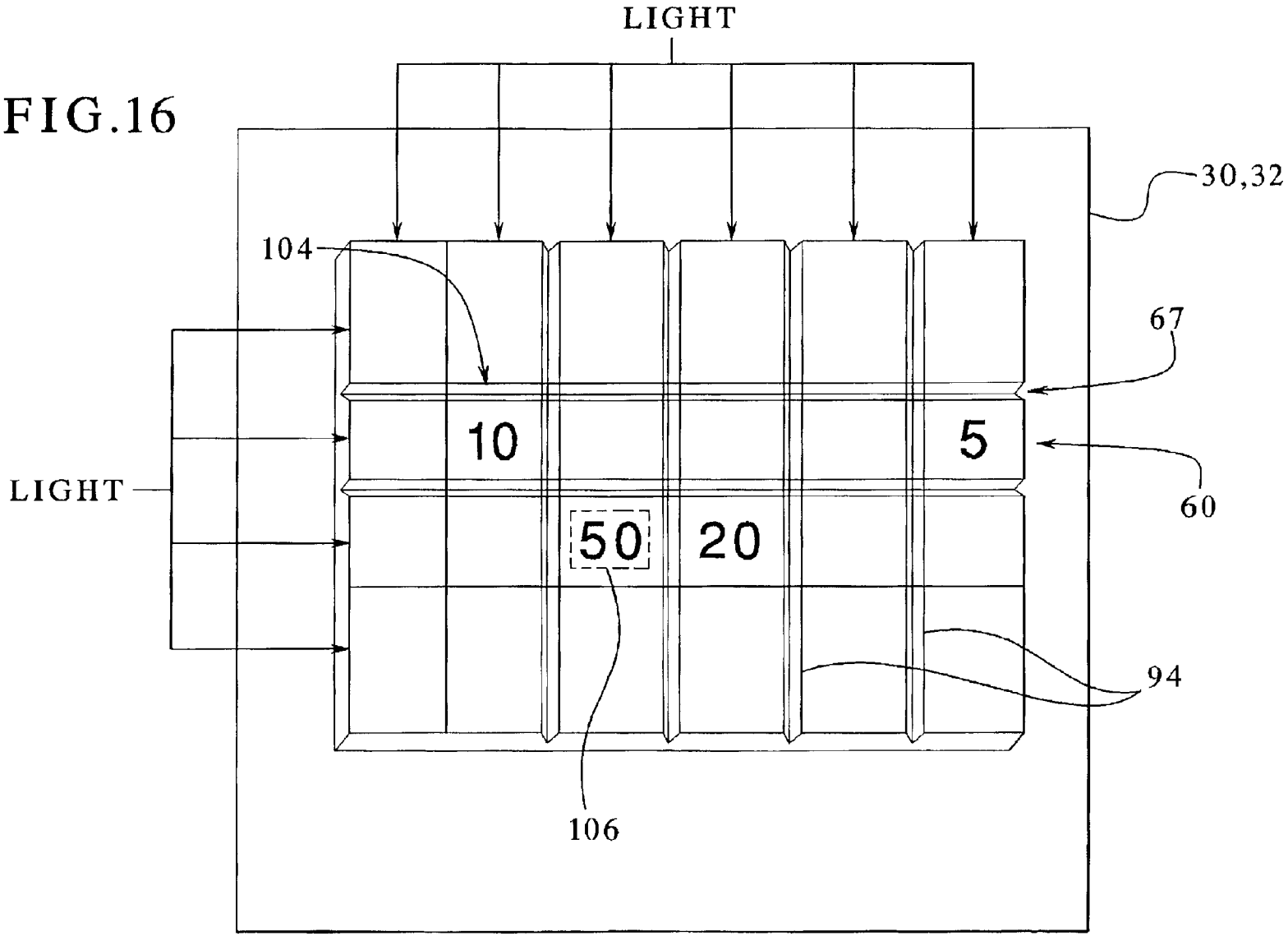
FIG. 16 is a front elevation view of another embodiment of the present invention illustrating the reflective layers shown in FIG. 12 used in a game to illuminate particular sections or symbols in the game.

The reflective layers 94 can be used to separate and illuminate different areas or specific refractive surfaces on a refractive light display 60. In FIG. 16, an example of this embodiment is illustrated where a refractive light display is mounted adjacent to a video display device 32. It should be appreciated that the refractive light display may be mounted adjacent to a mechanical display device, an award display, a symbol display or any other type of display on a gaming device. In this example, the functional refractive light display 60 provides a plurality of square sections 104 which include award symbols or awards 106. The sections 104 are formed by refractive surfaces 67 having reflective layers 94. It should be appreciated that one refractive surface, a plurality of refractive surfaces or any combination of refractive surfaces may have a reflective layer. The light sources or LED's (not shown) are positioned along a top and left edge of the functional refractive light display 60 to illuminate the square sections 104 and awards 106. The LED's could be positioned adjacent to and along the left and right sides of the functional refractive light display 60 or any combination of sides including all of the side of the display. It should be appreciated that the square shapes and the values may be formed with refractive surfaces in the same piece of edge-lit material or separate pieces of material. It should also be appreciated that the award symbols may be in only one section, a plurality of sections or any combination of sections on the refractive light display.

In this example, the gaming device 10 illuminates a refractive square section 104 and corresponding refractive award value or award 106 during a game or bonus game. The gaming device illuminates a particular award or awards 106 by directing light into the edge-lit material that is adjacent to the section and award. The light reflects from any reflective layers 94 and illuminates the section and corresponding award. One side of a section, a plurality of sides in a section or any combination of side may include a reflective layer 94. In another embodiment, the sections 104 are selections that illuminate after a player selects a particular section. The different sections 104 may also be illuminated with different colors of light to highlight a particular section or award, or a particular game mode or function.

In another embodiment, a channeling effect is displayed to a player where the sections are alternately illuminated so that a section having an award appears as if it is moving across the display. By alternately illuminating each of the square sections 104 and corresponding awards 106, the gaming device creates the channeling effect where the numbers and squares alternately illuminate across the screen. The reflective layers 94 reflect the light and prevent the light from entering other sections or areas of the refractive light display 60. Thus, a single section or a plurality of sections 104 may be illuminated at a particular time or times in a game.

For example, the gaming device alternately illuminates the square sections 104 and awards 106 until stopping on a particular award. The award that remains illuminated when the channeling effect stops is the award provided to the player. It should be appreciated that the awards may also be displayed on the video display device 102 as well as on the square sections 104 are formed in the functional refractive light display 60. It should also be appreciated that the awards may be formed in the functional refractive light display 60 and the sections 104 alternately illuminated on the video display device 102. Other shapes and display devices may be used as desired by the game implementor.

It should be appreciated that although the present invention is described in relation to particular types of games and bonus games, the refractive light display 60 described above may be used in any type of games and bonus games including but not limited to, award wheel games, games with selection displays, games with symbol displays, offer and acceptance games, dice games and other types of base games or bonus games on gaming devices.

While the present invention is described in connection with what is presently considered to be the preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a housing;

a refractive light display connected to said housing, said refractive light display including a first side and a second side, said first side of said refractive light display including a first refractive surface and a second refractive surface, said first and second refractive surfaces each having a first end and a second end, wherein said first end of said first refractive surface is at a point on said first side and said first end of said second refractive surface is at a different spaced-apart point on said first side, said first and second refractive surfaces extending from said first side toward said second side, and wherein said first refractive surface and said second refractive surface define at least part of a groove in said first side;

at least one light source connected to said housing for directing light into the refractive light display; and a processor for controlling the light source to selectively direct light into the refractive light display to pass the light through the first and second refractive surfaces and illuminate at least part of the groove defined by the first and second refractive surfaces in the first side of the refractive light display in coordination with a game function.

2. The gaming device of claim 1, wherein said refractive light display includes a plurality of the grooves which form a symbol, image, pattern or design.

3. The gaming device of claim 1, wherein the refractive light display includes a transparent edge-lit material.

4. The gaming device of claim 1, wherein the refractive light display includes a translucent edge-lit material.

5. The gaming device of claim 1, which includes a symbol display connected to the housing adjacent to the refractive light display, said symbol display including at least one symbol.

6. The gaming device of claim 5, wherein the symbol display includes a plurality of symbols.

7. The gaming device of claim 5, wherein the symbol display is a video display device.

8. The gaming device of claim 5, wherein the symbol display is a mechanical display device.

9. The gaming device of claim 5, wherein the symbol display is an award wheel controlled by the processor having a plurality of sections each including at least one symbol.

10. The gaming device of claim 9, wherein at least one of the sections includes a plurality of symbols.

11. The gaming device of claim 5, wherein the symbol display includes at least one player selectable selection associated with at least one symbol of the symbol display.

12. The gaming device of claim 1, which includes a plurality of light sources mounted to the housing adjacent to the refractive light display and controlled by the processor.

13. The gaming device of claim 12, wherein the plurality of light sources include a plurality of lights.

14. The gaming device of claim 1, wherein the light source includes a plurality of lights.

15. The gaming device of claim 14, wherein the plurality of lights are the same color.

16. The gaming device of claim 14, wherein the plurality of lights are different colors.

17. The gaming device of claim 1, wherein the refractive light display includes at least one section of edge-lit material having a refractive surface.

18. The gaming device of claim 17, wherein the section of edge-lit material includes a reflective material to prevent light from exiting at least one edge of said edge-lit material.

19. The gaming device of claim 18, wherein the reflective material is a reflective coating on said edge.

20. The gaming device of claim 18, wherein the reflective material is a material selected from the group consisting of: metallic paints, metal tapes, and metallic coatings.

21. The gaming device of claim 1, wherein the refractive light display is made from an acrylic edge-lit material.

22. The gaming device of claim 1, wherein the refractive light display is made from an edge-lit material selected from the group consisting of: plastic and glass.

23. The gaming device of claim 1, wherein the refractive light display includes a plurality of layers of edge-lit material each layer of edge lit material having a first side and a second side.

24. The gaming device of claim 23, wherein the first side of each of the layers of edge-lit material includes a refractive surface.

25. The gaming device of claim 24, which includes a plurality of light sources connected to the housing, wherein each light source is positioned to direct light into one of said layers of edge-lit material.

26. The gaming device of claim 1, wherein the game function includes a game mode.

27. The gaming device of claim 26, wherein the game mode is a mode selected from the group consisting of: an attract mode, an idle mode, a normal mode, a game mode, a bonus game mode, a game start mode, a jackpot mode, a cash out mode, and a player tracking mode.

28. The gaming device of claim 1, wherein the refractive light display includes a plurality of first and second refractive surfaces that define grooves in said side of the refractive light display, and wherein the processor causes the light source to selectively direct light into the refractive light display to illuminate at least part of the grooves.

29. The gaming device of claim 1, wherein the groove includes a v-shaped groove.

30. A gaming device comprising:

a housing;

a refractive light display connected to said housing, said refractive light display including a first side and a second side, said first side of said refractive light display including a first refractive surface and a second refractive surface, said first and second refractive surfaces each having a first end and a second end, wherein said first end of said first refractive surface is at a first point on said first side and said first end of said second refractive surface is at a different spaced-apart point on said first side, said first and second refractive surfaces extending from said first side toward said second side, and wherein said first refractive surface and said second refractive surface define at least a part of a groove in said first side;

a symbol display connected to said housing and positioned adjacent to the refractive light display, said symbol display having at least one symbol;

at least one light source connected to said housing for directing light into the refractive light display; and a processor for controlling the light source to selectively direct light into the refractive light display to pass the light through the first and second refractive surfaces to illuminate at least cart of the groove defined by the first and second refractive surfaces in the first side of the refractive light display and for indicating at least one symbol on the symbol display or at least one game mode.

31. The gaming device of claim 30, wherein the light source includes a plurality of lights.

32. The gaming device of claim 31, wherein the plurality of lights are the same color.

33. The gaming device of claim 31, wherein the plurality of lights are different colors.

34. The gaming device of claim 30, wherein the symbol display includes a plurality of symbols.

35. The gaming device of claim 30, wherein said symbol display is an award wheel controlled by the processor, and which includes a plurality of award symbols.

36. The gaming device of claim 30, wherein said symbol display is at least one reel.

37. The gaming device of claim 36, wherein the groove forms at least one payline associated with said reel.

38. The gaming device of claim 30, wherein said symbol display includes a plurality of player selectable selections.

39. The gaming device of claim 30, wherein said symbol display is a video display device.

40. The gaming device of claim 30, wherein the refractive light display includes a plurality of refractive surfaces which form a pattern, image or design.

41. The gaming device of claim 30, wherein the refractive surface functions as a symbol indicator.

42. The gaming device of claim 30, wherein the refractive light display includes a plurality of first and second refractive surfaces that define grooves in the said side of the refractive light display, and wherein the processor causes the light source to selectively direct light into the refractive light display to illuminate at least part of the grooves.

43. The gaming device of claim 30, wherein the groove includes a v-shaped groove.

44. A gaming device comprising:

a housing;

an award display movably mounted to said housing, said award display including at least one award symbol;

a refractive light display mounted to said housing and adjacent to said award display, said refractive light display including a first side and a second side, said first side of said refractive light display including a first refractive surface and a second refractive surface, said first and second refractive surfaces each having a first end and a second end, wherein said first end of said first refractive surface is at a point on said first side and said first end of said second refractive surface is at a different spaced-apart point on said first side, said first and second refractive surfaces extending from said first side toward said second side, and wherein said first refractive surface and said second refractive surface define at least part of a groove in said first side;

at least one light source connected to said housing for directing light into the refractive light display; and a processor for controlling said award display and the light source to selectively direct light into the refractive light display to pass the light through the first and second refractive surfaces to illuminate at least part of the groove defined by the first and second refractive surfaces in the first side of the refractive light display and for indicating at least one symbol on the award display or at least one game mode.

45. The gaming device, of claim 44, wherein the groove functions as an award indicator selected from the group consisting of: a pointer, barrier, box, area, payline and indicator.

46. The gaming device of claim 44, wherein the light source includes a plurality of lights.

47. The gaming device of claim 46, wherein the lights are different colors.

48. The gaming device of claim 44, wherein the award display is an award wheel rotatably mounted to the housing and having a plurality of award symbols.

49. The gaming device of claim 44, wherein the refractive light display includes a plurality of first and second refractive surfaces that define grooves in the said side of the refractive light display, and wherein the processor causes the light source to selectively direct light into the refractive light display to illuminate at least part of the grooves.

50. The gaming device of claim 44, wherein the groove includes a v-shaped groove.

51. A gaming device comprising:

a housing;

an award display movably mounted to said housing, said award display including at least one award symbol;

a refractive light display movably mounted to said housing and adjacent to said award display, said refractive light display including a first side and a second side, said first side of said refractive light display including a first refractive surface and a second refractive surface, said first and second refractive surfaces each having a first end and a second end, wherein said first end of said first refractive surface is at a point on said first side and said first end of said of said second refractive surface is at a different spaced-apart point on said first side, said first and second refractive surfaces extending from said first side toward said second side, and wherein said first refractive surface and said second refractive surface define at least part of a groove in said first side of said refractive light display;

at least one light source connected to said housing for directing light into the refractive light display; and a processor for controlling said award display and the light source to selectively direct light into the refractive light display to pass the light through the first and second refractive surfaces to illuminate at least part of the groove defined by the first and second refractive surfaces in the first side of the refractive light display and for indicating at least one symbol on the award display or at least one game mode.

52. The gaming device of claim 51, wherein said processor is adapted to cause the award display and said refractive light display to move in the same direction.

53. The gaming device of claim 51, herein said processor is adapted to cause the award display and said refractive light display to move in different directions.

54. The gaming device of claim 51, wherein the light source includes a plurality of lights.

55. The gaming device of claim 54, wherein the lights are different colors.

56. The gaming device of claim 51, wherein the refractive light display includes a plurality of first and second refractive surfaces that define grooves in said side of the refractive light display, and wherein the processor causes the light source to selectively direct light into the refractive light display to illuminate at least part of the grooves.

57. The gaming device of claim 51, wherein the groove includes a v-shaped groove.

58. A gaming device comprising:

a housing;

a reel mounted to said housing, said reel having at least one symbol;

a refractive light display mounted to said housing adjacent to said reel, said refractive light display including a first side and a second side, said first side of said refractive light display having a first refractive surface and a second refractive surface, said first and second refractive surfaces each having a first end and a second end, wherein said first end of said first refractive surface is at a point on said first side and said first end of said second refractive surface is at a different spaced-apart point on said first side, said first and second refractive surfaces extending from said first side toward said second side, and wherein said first refractive surface and said second refractive surface define at least part of a groove that functions as a pay indicator;

at least one light source connected to said housing for directing light into the refractive light display; and a processor for controlling the light source to selectively direct light into the refractive light display to pass the light through the first and second refractive surfaces to illuminate at least part of the groove defined by the first and second refractive surfaces in the first side of the refractive light display to indicate at least one symbol or at least one game mode.

59. The gaming device of claim 58, wherein the reel includes a plurality of symbols.

60. The gaming device of claim 58, wherein the award display includes a plurality of reels with a plurality of symbols.

61. The gaming device of claim 58, which includes a plurality of first and second refractive surfaces that define grooves that function as paylines.

62. The gaming device of claim 58, wherein the pay indicator is selected from the group consisting of: a payline, barrier, an arrow, an area and a box.

63. The gaming device of claim 58, wherein the pay indicator extends horizontally, vertically, diagonally or any combination thereof.

64. The gaming device of claim 58, wherein the refractive light display includes a plurality of first and second refractive surfaces that define grooves in the said side of the refractive light display, and wherein the processor causes the light source to selectively direct light into the refractive light display to illuminate at least part of the grooves.

65. The gaming device of claim 58, wherein the groove includes a v-shaped groove.

66. A gaming device comprising:

a housing;

a refractive light display connected to said housing, said refractive light display including a first side and a second side, said first side of the refractive light display including a first refractive surface and a second refractive surface, said first and second refractive surfaces each having a first end and a second end, wherein said first end of said first refractive surface is at a point on said first side and said first end of said second refractive surface is at a different spaced-apart point on said first side, said first and second refractive surfaces extending from said first side toward said second side, and wherein said first refractive surface and said second refractive surface define at least part of a groove in said first side;

at least one light source connected to said housing for directing light into the refractive light display;

a sub-processor for controlling the light source to selectively direct light into the refractive light display to pass the light through the first and second refractive surfaces and illuminate at least part of the groove defined by the first and second refractive surfaces in the first side of the refractive light display; and a processor for communicating with the sub-processor and for co-acting with the refractive light display to indicate a game function or a game mode.

67. The gaming device of claim 66, wherein the refractive light display includes a plurality of first and second refractive surfaces that define grooves in said side of the refractive light display, and wherein the processor causes the light source to selectively direct light into the refractive light display to illuminate at least part of the grooves.

68. The gaming device of claim 66, wherein the groove includes a v-shaped groove.

69. A gaming device comprising:

a housing;

a refractive light display connected to said housing, said refractive light display including a first side, a second side and at least one reflective layer, said first side of the refractive light display including a first refractive surface and a second refractive surface, said first and second refractive surfaces each having a first end and a second end, wherein said first end of said first refractive surface is at a point on said first side and said second end of said second refractive surface is at a different spaced-apart point on said first side, said first and second refractive surfaces extending from said first side toward said second side, and wherein said first refractive surface and said second refractive surface define at least part of a groove in said first side;

at least one light source connected to said housing for directing light into, the refractive light display; and a processor for controlling the light source to selectively direct light into the refractive light display to pass the light through the first and second refractive surfaces and illuminate at least part of the groove formed by the first and second refractive surfaces in the first side of the refractive light display and to indicate a game function or a game mode, wherein the reflective layer prevents said light from exiting from at least one portion of the refractive light display.

70. The gaming device of claim 69, wherein the reflective layer includes a reflective material.

71. The gaming device of claim 70, wherein the reflective material is selected from the group consisting of: metallic paints, metal tapes, and metallic coatings.

72. The gaming device of claim 69, wherein the refractive light display includes a plurality of refractive surfaces and reflective layers.

73. The gaming device of claim 69, wherein the refractive light display includes a plurality of first and second refractive surfaces that define grooves in said side of the refractive light display, and wherein the processor causes the light source to selectively direct light into the refractive light display to illuminate at least part of the grooves.

74. The gaming device of claim 69, wherein the groove includes a v-shaped groove.

75. A gaming device comprising:

a housing;

a refractive light display mounted to said housing having a plurality of layers, each of said layers including a first side and a second side, each of said first sides of said layers including a first refractive surface and a second refractive surface, said first and second refractive surfaces each including a first end and a second end, wherein said first end of said first refractive surface is at a point on said first side and said first end of said second refractive surface is at a different spaced-apart point on said first side, said first and second refractive surfaces extending from said first side toward said second side, and wherein said first refractive surface and said second refractive surface define at least part of a groove in said first sides of said layers;

a plurality of light sources connected to said housing for directing light into each of said layers; and a processor for controlling the light sources to selectively direct light into the refractive light display to pass the light through the first and second refractive surfaces and illuminate at least part of the groove defined by the first and second refractive surfaces in the first side of each of the layers to coordinate with a game function, indicate at least one symbol or indicate a game mode.

76. The gaming device of claim 75, wherein the refractive light display includes a plurality of first and second refractive surfaces that define a plurality of grooves and, wherein the grooves form a pattern, image or design.

77. The gaming device of claim 75, wherein the refractive light display includes a plurality of first and second refractive surfaces that define grooves in said side of the refractive light display, and wherein the processor causes the light source to selectively direct light into the refractive light display to illuminate at least part of the grooves.

78. The gaming device of claim 75, wherein the groove includes a v-shaped groove.

79. A method for operating a gaming device, said method comprising the steps of:

(a) activating a symbol display including a plurality of symbols in a game;

(b) causing a light source to direct light into at least one edge of a refractive light display adjacent to said symbol display; and (c) refracting said light through a first refractive surface and a second refractive surface, said first and second refractive surfaces each having a first end and a second end, wherein said first end of said first refractive surface is at a point on a side of said refractive light display and said first end of said second refractive surface is at a different spaced-apart point on said side of said refractive light display, said first and second refractive surfaces extending from said side toward another side of said refractive light display, wherein said first refractive surface and said second refractive surface define at least part of a groove in the side of the refractive light display, and wherein said light refracting through said first and second refractive surfaces illuminates at least a part of the groove to indicate at least one of the symbols of the symbol display.

80. The method of claim 79, wherein the symbol display is an award wheel having a plurality of award symbols.

81. The method of claim 79, which further includes the step of moving the symbol display and the refractive light display simultaneously.

82. The method of claim 79, which further includes the step of alternately moving the symbol display and the refractive light display.

83. A method for operating a gaming device, said method comprising the steps of:

(a) spinning one or more reels;

(b) causing a light source to direct light into at least one edge of a refractive light display; and (c) refracting said light through a first refractive surface and a second refractive surface, said first and second refractive surfaces each having a first end and a second end, wherein said first end of said first refractive surface is at a point on a side of said refractive light display and said first end of said second refractive surface is at a different spaced-apart point on said side of said refractive light display, said first and second refractive surfaces extending from said side toward another side of said refractive light display, wherein said first refractive surface and said second refractive surface define at least part of a groove in the side of the refractive light display, and wherein said light refracting through said first and second refractive surfaces illuminates at least a part of the groove a pay indicator for said reels.

* * * * *

UNITED STATES PATENT AND TRADEMARK OFFICE

CERTIFICATE OF CORRECTION

PATENT NO. : 7,048,631 B2
APPLICATION NO. : 09/967267
DATED : May 23, 2006
INVENTOR(S) : Jamie J. Goins et al.

It is certified that error appears in the above-identified patent and that said Letters Patent is hereby corrected as shown below:

IN THE CLAIMS:

In Claim 83, column 22, line 41, change "groove a pay" to --groove to display a pay--.

Signed and Sealed this

Twelfth Day of September, 2006

JON W. DUDAS
*Director of the United States Patent and Trademark Office*